US007070541B2

(12) United States Patent
Madigan et al.

(10) Patent No.: US 7,070,541 B2
(45) Date of Patent: Jul. 4, 2006

(54) EDUCATIONAL TRACKS AND APPARATUSES

(76) Inventors: Stephen Joseph Madigan, 232 Zachary Walk., Murphy, TX (US) 75094; Winifred Jean Madigan, 232 Zachary Walk, Murphy, TX (US) 75094; Larry Eugene Hess, 307 E. 28th Division Hwy., Lititz, PA (US) 17543; Cynthia Anne Hess, 307 E. 28th Division Hwy., Lititz, PA (US) 17543

( * ) Notice: Subject to any disclaimer, the term of this patent is extended or adjusted under 35 U.S.C. 154(b) by 101 days.

(21) Appl. No.: 10/824,963

(22) Filed: Apr. 15, 2004

(65) Prior Publication Data

US 2005/0233862 A1 Oct. 20, 2005

(51) Int. Cl.
*A63B 17/00* (2006.01)

(52) U.S. Cl. ..... 482/35; 434/247; 434/255

(58) Field of Classification Search ..... 482/35–37; 434/247, 255; 472/12, 36, 137; 238/10 R, 238/10 E, 10 F, 367; 273/440, 444, 449; 104/DIG. 1, 60; 105/1.4, 1.5; 446/446
See application file for complete search history.

(56) References Cited

U.S. PATENT DOCUMENTS 1,142,150 A * 6/1915 Dorrill ..... 238/10 R
2,365,117 A 12/1944 Stafford
2,620,185 A 12/1952 Harding
2,685,140 A * 8/1954 Nedwick ..... 434/255
3,258,236 A 6/1966 Moritz
3,339,920 A 9/1967 Moritz
3,464,624 A * 9/1969 Christiansen ..... 238/10 R
3,545,747 A * 12/1970 Thomas ..... 273/449
3,582,068 A 6/1971 Hallgren
3,747,233 A 7/1973 Berryman
4,149,712 A 4/1979 Murphy
4,627,612 A 12/1986 Gehlbach (Continued)

OTHER PUBLICATIONS

SPORTTIME, Catalog, Foam Coordination Boards, Spring 2004, p. 57, Atlanta, GA, USA.

(Continued)

*Primary Examiner*—Stephen R. Crow
*Assistant Examiner*—Allana Lewin

(57) ABSTRACT

An educational apparatus is traversed horizontally for the purpose of increasing learning capabilities is pictured. The apparatus is in the design of a figure eight lying on its side longitudinally and laterally intersected at its center by a column and row of straight tracks 30. The apparatus is comprised of tracks, straight 30, arced 40, and curved 50, contiguously connected to one another and an octagon shaped distinct end coupler 96 used as a bridge to connect the non-contiguous ends of tracks, straight 30, arced 40, and curved 50. The distinct end coupler 96 is located in the center of the apparatus. The distinct end coupler 96 is not only a structure used to connect the non-contiguous ends of tracks but also a station from which a human receives instruction prior to traversing the apparatus and a portal used by a walking human to traverse from track to track in the proper direction and sequence, important for basic brain processing methods. The apparatus is designed to be traversed by a human in specific patterns in order to promote, foster, and facilitate the development of brain functions controlling balance, coordination, spatial awareness, and vestibular function thereby increasing learning capabilities. As a result of traversing the apparatus in specific patterns, the human brain will process alphabetic and numeric symbols more efficiently. This is especially important in the development of early childhood learners. The educational importance for the invention is based upon brain research findings that support the link of sensory motor development and increased learning capacity.

20 Claims, 24 Drawing Sheets

U.S. PATENT DOCUMENTS

| | | | | |
|---|---|---|---|---|
| 5,203,752 | A | 4/1993 | Frankel | |
| 5,440,996 | A * | 8/1995 | Cottino | 104/47 |
| 5,924,960 | A | 7/1999 | Cohen | |
| 6,247,553 | B1 | 6/2001 | Jones | |
| 6,447,427 | B1 | 9/2002 | Myrland | |
| 6,668,975 | B1 | 12/2003 | Skipper | |
| 2004/0009845 | A1 | 1/2004 | Johnson | |

OTHER PUBLICATIONS

SPORTTIME, Catalog, BalanceTrac, Spring 2004, p. 56, Atlanta, GA, USA.

SPORTTIME, Catalog, RungWay, Spring 2004, p. 52, Atlanta, GA, USA.

* cited by examiner

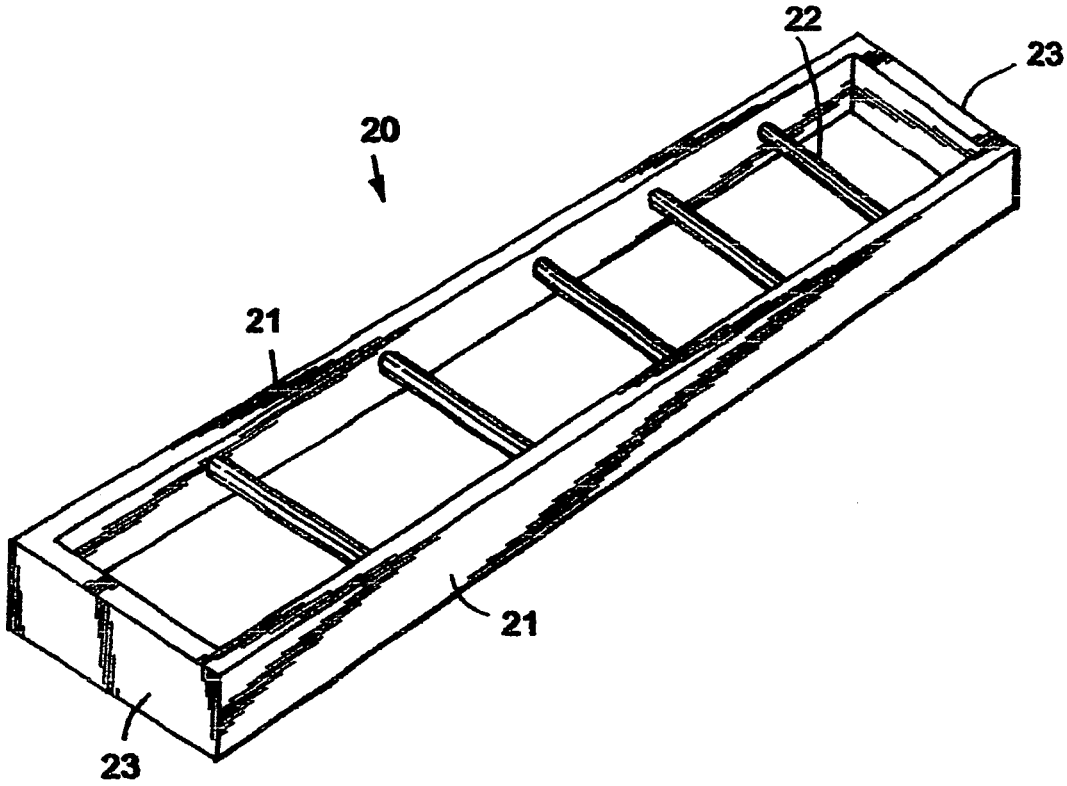
FIG. 1 – Prior Art

EDUCATIONAL TRACKS AND APPARATUSES

CROSS-REFERENCE TO RELATED APPLICATIONS

Not Applicable

Federally Sponsored Research

Not Applicable

Sequence Listing or Program

Not Applicable

BACKGROUND OF INVENTION

1. Field of Invention

The invention relates to educational equipment over which a human horizontally traverses using its lower limbs to promote, foster, and facilitate learning adapting brain research findings that support the link of movement to learning said educational equipment comprising one or more tracks, straight, arced, or curved, and design apparatuses comprising one or more of said tracks.

2. Description of Prior Art and Related Art

Apparatuses traversed horizontally by a human have been previously developed for educational, athletic, and therapeutic purposes. These apparatuses include equipment traversed using the upper limbs and the lower limbs. The term horizontal ladder has been used to describe monkey bar like apparatuses traversed using the upper limbs. Refer to U.S. Pat. No. 4,149,712 issued in April of 1979 to Murphy; U.S. Pat. No. 4,627,612 issued in December of 1986 to Gehlbach; and U.S. Pat. No. 5,203,752 issued in April of 1993 to Frankel. The following discussion will be limited to prior and related art apparatuses traversed using the lower limbs.

U.S. Pat. No. 3,339,920 issued in September of 1967 to Moritz, titled "Child's Coordination Training Device," describes an enclosed, rectangular ladder that may be used in horizontal and inclined positions, the latter position with the aid of one or two supports also described in the patent. The ladder is comprised of two elongated, rectangular rails joined together by a series of rungs affixed to the interior sides of the rails and two end boards each affixed to the ends of the rails at each end of the ladder. The rungs and end boards are perpendicularly affixed to the rails serving to hold the opposing rails parallel to one another. The end boards and the rails are of the same height. The ladder is intended to be used in an educational environment to increase perception, attentiveness, and coordination. The author states that learning ability is increased at an earlier age allowing for earlier assimilation of educational material.

The prior art ladder is elongated and rectangular in shape whereas the invention comprises tracks that are not only elongated and rectangular but also arced and curved. The prior art ladder has affixed rungs whereas the invention comprises tracks with readily detachable or affixed steps. The prior art ladder is enclosed comprising end boards that hinder entering or exiting a ladder or traversing between ladders whereas the invention is free of end boards removing an obstruction to traversing the tracks. The prior art ladder has no means to connect to another ladder whereas the invention comprises tracks with means to connect to another track. The prior art ladder stands alone whereas the invention comprises design apparatuses comprising tracks, straight, arced, or curved, wherein each apparatus promotes, fosters, and facilitates learning in a far meaningful way than traversing a simple, elongated, enclosed, rectangular ladder. The invention further includes a distinct end coupler. This structure serves multiple purposes. First, it is used as an intermediate joining piece connecting with the ends of two non-contiguous tracks thereby bridging the ends of those tracks. Second, it is used as an agent to traverse from one track to another. Finally, the distinct end coupler is used as a station from which a human receives traversing instructions. The invention further includes an anti-tip device serving to protect a human while a straight track is under foot and as an aid in assembling a straight track.

U.S. Pat. No. 3,582,068 issued in June of 1976 to Hallgren describes exercise and gymnastic equipment horizontally traversed by a human commonly referred to as a balance beam. The invention may be horizontally traversed by a human using the steps of a track or the top of each rail, as a balance beam.

U.S. Pat. No. 2,365,117 issued in December of 1944 to Stafford describes a physical training apparatus developed for the military. An elongated, rectangular ladder is an element of the apparatus. The track is in an elevated, horizontal position that may be traversed by a walking or running human. However, there is no mention whether the ladder is intended to be traversed using the lower limbs. The invention comprises tracks, straight, arced, or curved, horizontally traversed and does not include each element of the physical training apparatus.

U.S. Pat. No. 2,620,185 issued in December of 1952 to Harding describes a climbing and sliding apparatus used outdoors for exercise purposes. A human ascends the rungs of a ladder to a sliding position. The upper and lower limbs are used to ascend the ladder. Both the ladder and slide are elements of the invention. The invention comprises tracks, straight, arced, or curved, horizontally traversed and does not include each element of the climbing and sliding apparatus.

U.S. Pat. No. 3,747,233 issued in July of 1973 to Berryman describes a therapeutic walking apparatus used for therapeutic purposes. A horizontal planar platform is an element of the apparatus. The platform or walkway comprises a plurality of raised footprints upon which a walking human traverses. The footprints are positioned in two rows in an alternating fashion. The apparatus also comprises a single parallel bar attached to the platform and used by the traversing human as an aid. The invention comprises tracks, straight, arced, or curved, horizontally traversed and does not include each element of the therapeutic walking apparatus.

U.S. Pat. No. 5,924,960 issued in July of 1999 to Cohen describes a therapeutic walking apparatus used for therapeutic purposes. A horizontal planar platform is an element of the apparatus. The platform or walkway comprises a plurality of holes into which steps with dole ends are placed. The steps are positioned in two rows in an alternating fashion. A human traverses the apparatus by either walking upon or over the steps. The apparatus also comprises a set of parallel bars attached to the platform and used by the traversing human as an aid. The invention comprises tracks, straight, arced, or curved, horizontally traversed and does not include each element of the therapeutic walking apparatus.

U.S. Pat. App. No. 2004/0009845 filed in January of 2004 by Johnson describes a balance and gait training board apparatus used for therapeutic purposes. The apparatus is comprised of a rectangular shaped planar platform on which detachable hurdles that may be flipped are positioned. The platform is comprised of two half sections coupled together by means independent of the hurdles. Each half section comprises an outer raised wall into which the hurdles are inserted and specifically spaced markings for gait assessment. A human horizontally traverses the apparatus by stepping on or over the hurdles. The invention comprises tracks, straight, arced, or curved, comprising two rails, joined together by steps. The preferred and second embodiments of the invention comprise rails with the means to connect to another track or a distinct end coupler. The invention does not include each element of the balance and gait training board apparatus.

U.S. Pat. No. 6,447,427 issued in September of 2002 to Myrland describes an agility training ladder. The ladder is comprised of two elongated non-rigid rails capable of folding and substantially planar shaped rungs. The rails are positioned parallel to one another. The ladder is positioned horizontally and traversed by a human primarily by alternatively stepping into rectangles formed by the rails and rungs. The invention comprises tracks, straight, arced, or curved, comprising two rigid rectangular, arced, or curved rails, respectively, joined together by rungs. Each rail comprises a means to connect to other tracks or a distinct end coupler. The invention does not include each element of the agility training ladder.

Unpatented prior and related art includes equipment comprising a rectangular foam board. Multiple boards may be arranged in the shape of a rectangular structure traversed horizontally. The boards are held together by hook and loop fabric located on the sides of each board. The invention comprises tracks, straight, arced, or curved, traversed horizontally and design apparatuses comprised of tracks and, if necessary, a distinct end coupler used to bridge the non-contiguous ends of tracks. The invention does not include each element of a rectangular foam board.

Unpatented prior and related art includes equipment comprising an elongated, rectangular pathway comprised of rungs immediately strung together by a cord. The pathway is traversed horizontally. The invention comprises tracks, straight, arced, or curved, traversed horizontally and does not include each element of the pathway.

Unpatented prior and related art includes equipment comprising straight and curved foam boards each board comprising connecting elements located at each end of a board. When the boards are joined, a balance beam is created that may be traversed horizontally in a straight or curved pattern. The invention comprises tracks, straight, arced, or curved, traversed horizontally and does not include each element of a straight or curved board.

Objects and Advantages

The primary object of the invention is to provide educational equipment that promotes, fosters, and facilitates learning adapting brain research findings that support the link of movement to learning. The result achieved by a human traversing a track or an apparatus, comprising tracks, is increased sensory motor development, longer focus and attention, coordination of motor skills, better balance in the vestibular system, awareness of basic rhythmic patterns, and improved learning readiness. The basic design of the tracks, including the shapes and colors of the steps, and the designs of the apparatuses provide the framework for the development of academic concepts including, but not limited to, color, shape, and number recognition, basic math operations, early literacy, reading readiness, handwriting skills, map skills, time concepts, and other basic early childhood curriculum.

Another object of the invention is to provide educational equipment that may be used simultaneously by more than one human thereby developing team concepts, peer help, and cooperation skills resulting in better social behavior and life skills.

Another object of the invention is to provide educational equipment with multiple uses diversifying the learning experience. A track and the apparatuses comprising tracks must be designed to accommodate lateral, longitudinal, circular, or elliptical traversing using the steps or a rail as a balance beam. A track and the apparatuses comprising tracks must be able to accommodate the stride, familiarity, and traversing method of different users. Accordingly, the distance between the steps, the height of the steps, and the distance between the rails should be adjustable.

Another object of the invention is to provide a convenient, simple means to connect a track directly to another track or indirectly to another track with the aid of a distinct end coupler.

Another object of the invention is to provide a means whereby a track or an apparatus, comprising tracks, may be easily assembled or disassembled or modified by adding or removing steps without the necessity of dismantling the track.

A further object of the invention is to provide increased safety beyond the design itself in an effort to avoid shifting or tipping of a track or apparatus comprising tracks while under foot.

Still another object of the invention is to provide educational equipment that may be easily transported and stored.

SUMMARY

The invention comprises tracks, straight, arced, or curved, distinct end couplers, an anti-tip device, and various design apparatuses comprising tracks and one or more distinct end couplers, if necessary. The invention is horizontally traversed by a human using the steps of a track or a rail as a balance beam. As a result learning is promoted, fostered, and facilitated. The invention is a significant improvement over prior art.

DRAWINGS—FIGURES

In the drawings, closely related figures share the same numbers but different alphabetic suffixes.

FIG. 1 shows a perspective view of a prior art enclosed, rectangular ladder.

FIG. 6C shows a perspective view of a readily detachable rung with a triangular shaped colored footing.

Figure 21:
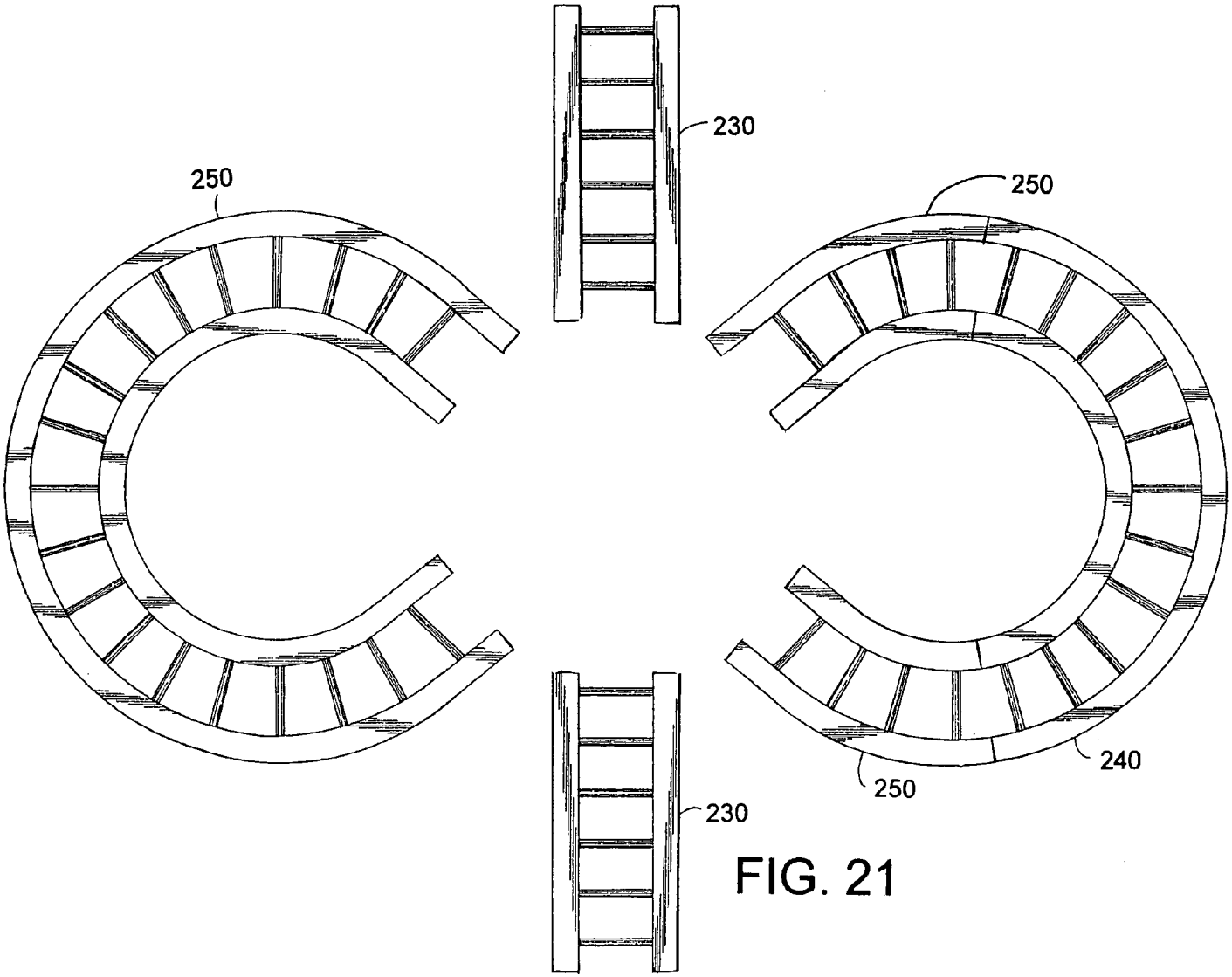

FIG. 21 shows a topside view of tracks comprising the design of two non-contiguous sets of connected arced and curved tracks each in the shape of a horseshoe located on the left and right sides of the design the open ends of each horseshoe shaped set of tracks located directly opposite and laterally positioned to one another and two non-contiguous straight tracks centrally located on the upper and lower sides of the design directly opposite and longitudinally positioned to one another, all of the horseshoe shaped sets of tracks and straight tracks border an octagon shaped open area in the middle of the design.

Figure 22:
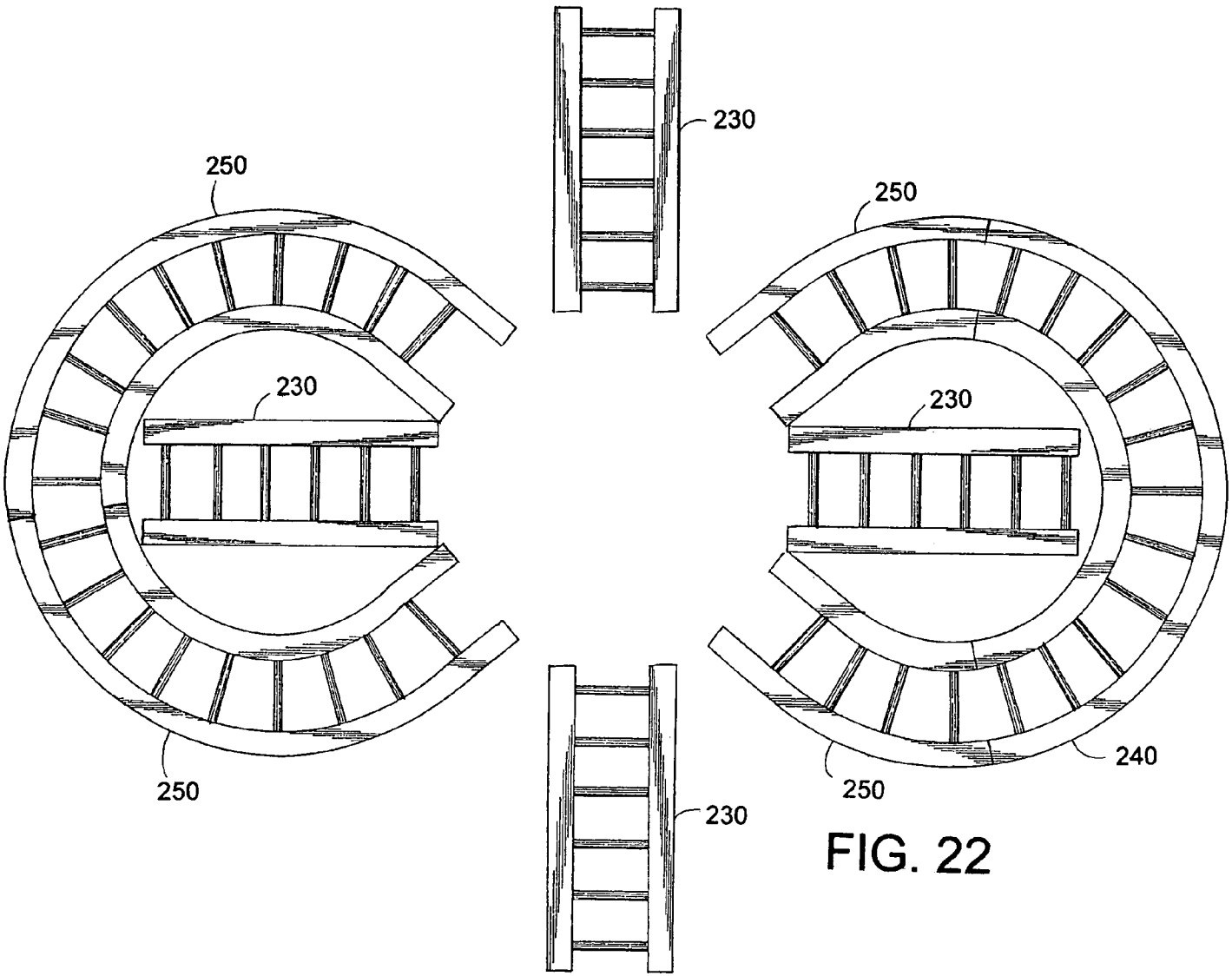

FIG. 22 shows a topside view of tracks comprising the design of two non-contiguous sets of connected arced and curved tracks each in the shape of a horseshoe located on the left and right sides of the design, within each of which a straight track is laterally and centrally positioned the ends of the each straight track abutting or lying at the interior sides of the horseshoe shaped set of tracks, the open ends of each horseshoe shaped set of tracks directly opposite and laterally positioned to one another and two non-contiguous straight tracks centrally located on the upper and lower sides of the design directly opposite and longitudinally positioned to one another, all of the horseshoe shaped sets of tracks, inclusive of the partially enclosed laterally positioned straight tracks, and the longitudinally positioned straight tracks border an octagon shaped open area in the middle of the design.

Figure 23:
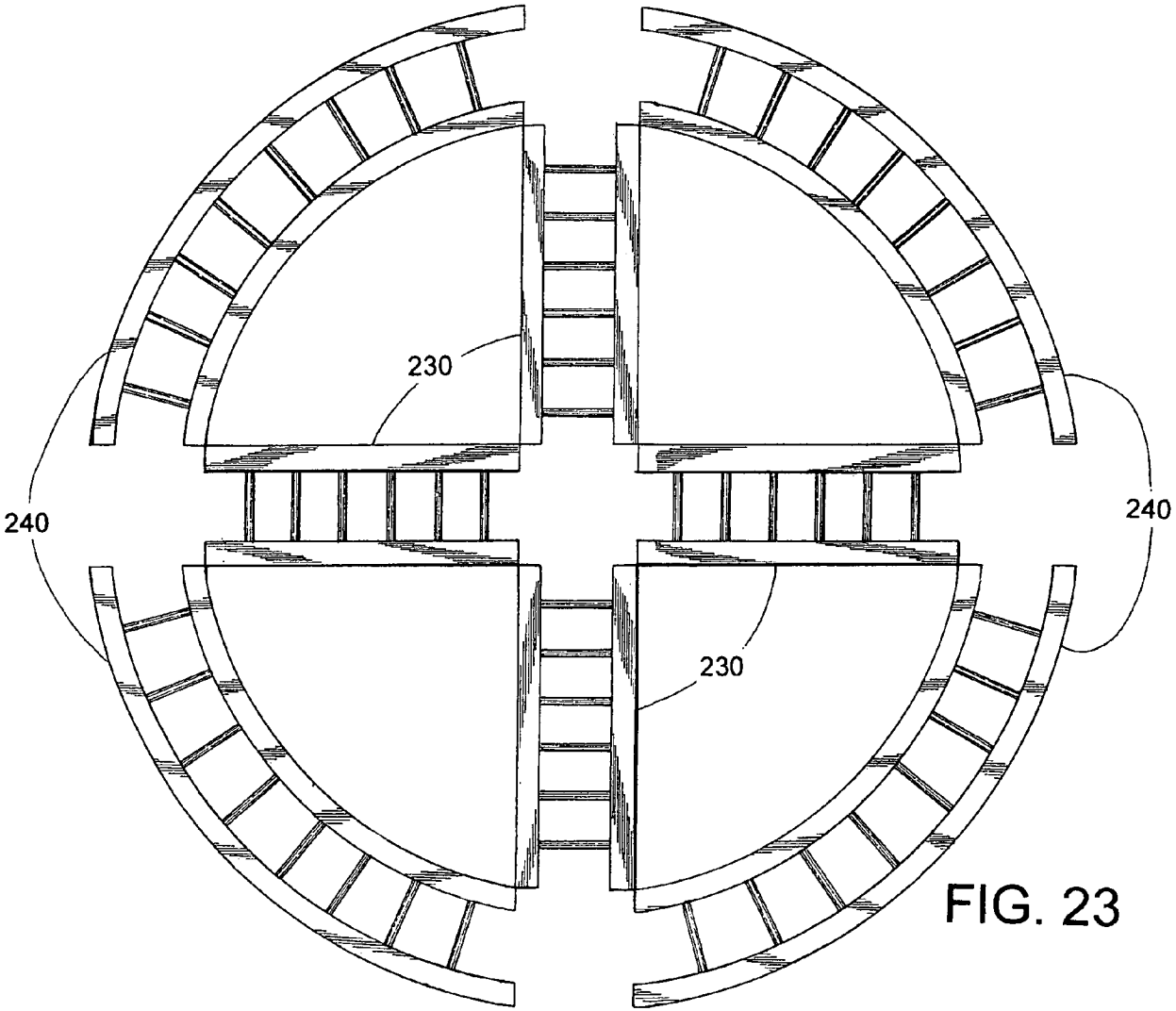

FIG. 23 shows a topside view of tracks comprising the design of a circle enclosing a plus sign.

DRAWINGS—REFERENCE NUMERALS

20 Prior art enclosed, rectangular ladder
21 Prior art elongated, rectangular rail
22 Prior art rung
23 Prior art rectangular end board
30 Preferred embodiment of a straight track
31 Preferred embodiment of a rectangular rail
32 Interior side of a rectangular rail
33 Top side of a rectangular rail
34 Exterior side of a rectangular rail
35 Bottom side of a rectangular rail
36 End of a rectangular rail
40 Preferred embodiment of an arced track
41 Preferred embodiment of an arced rail
42 Interior side of an arced rail
43 Top side of an arced rail
44 Exterior side of an arced rail
45 Bottom side of an arced rail
46 End of an arced rail
50 Preferred embodiment of a curved track
51 Preferred embodiment of a curved rail
52 Interior side of a curved rail
53 Top side of a curved rail
54 Exterior side of a curved rail
55 Bottom side of a curved rail
56 End of a curved rail
60 Track connecting element
61 Interfitting male connector, rail end
62 Interfitting female connector, rail end
63 Step insertion element
64 Square shaped rung insertion element
65 Upper row of square shaped rung insertion elements
66 Lower row of square shaped rung insertion elements
67 Anti-slide element
70 Readily detachable step, with geometrically shaped colored footing
71 Readily detachable rung
72 Affixed flange
73 Squared rung closure, with affixed flange

74 Geometrically shaped rung footing
75 Squared rung closure, with a threaded female fastener
76 Threaded male flange fastener
77 Readily detachable rung, oval shaped colored footing
78 Readily detachable rung, rectangular shaped colored footing
79 Readily detachable rung, triangular shaped colored footing
80 Anti-tip device
81 Elongated, rectangular shaped planar surface
82 Work holder area
83 Anti-tip element
84 Exterior work stop abutment
85 Interior work stop abutment
86 Step insertion element, exterior abutment
87 Square shaped rung insertion element, exterior abutment
90 Geometrically shaped distinct end coupler
91 Planar surface of distinct end coupler
92 Interfitting male connector, distinct end coupler side
93 Interfitting female connector, distinct end coupler side
94 Elongated bridging stripe, distinct end coupler
95 Distinct end coupler, diamond shaped
96 Distinct end coupler, octagon shaped
97 Distinct end coupler, rectangular shaped
130 Second embodiment of a straight track
131 Second embodiment of a rectangular rail
140 Second embodiment of an arced track
141 Second embodiment of an arced rail
150 Second embodiment of a curved track
151 Second embodiment of a curved rail
170 Affixed step, with geometrically shaped colored footing
171 Affixed rung
174 Geometrically shaped affixed rung footing
177 Affixed rung, oval shaped colored footing
178 Affixed rung, rectangular shaped colored footing
179 Affixed rung, triangular shaped colored footing
230 Third embodiment of a straight track
231 Third embodiment of a rectangular rail
240 Third embodiment of an arced track
241 Third embodiment of an arced rail
250 Third embodiment of a curved track
251 Third embodiment of a curved rail

DETAILED DESCRIPTION

PREFERRED EMBODIMENT—FIGS. 2A, 2B, 3A, 3B, 4A, 4B, 5A, 5B, 5C

The invention is an improvement to prior art. FIG. 1 shows a perspective view of prior art, an enclosed rectangular shaped ladder 20 traversed horizontally by a human. The elements of said ladder consist of two elongated rigid, rectangular rails 21 each rail of equal dimensions. The rails are joined by rungs 22 of equal length, perpendicularly affixed to the interior side of each rail serving to hold the rails in a fixed parallel relationship to each other. Each affixed rung is of a height substantially the same. The rails are also held in place by two rectangular, rigid end boards 23 equal in height to the rails.

A preferred embodiment of the invention comprises straight 30, arced 40, and curved 50 tracks, each track comprising two rails joined together by readily detachable steps with a geometrically shaped colored footing 70 and a means 60 to connect to other tracks. Said preferred embodiment is described below and claimed in independent Claim 1. For purposes of the specification and claims, an arc is defmed as a segment of a circle, and a curve is defined as a line deviating from straightness.

Figure 2A:
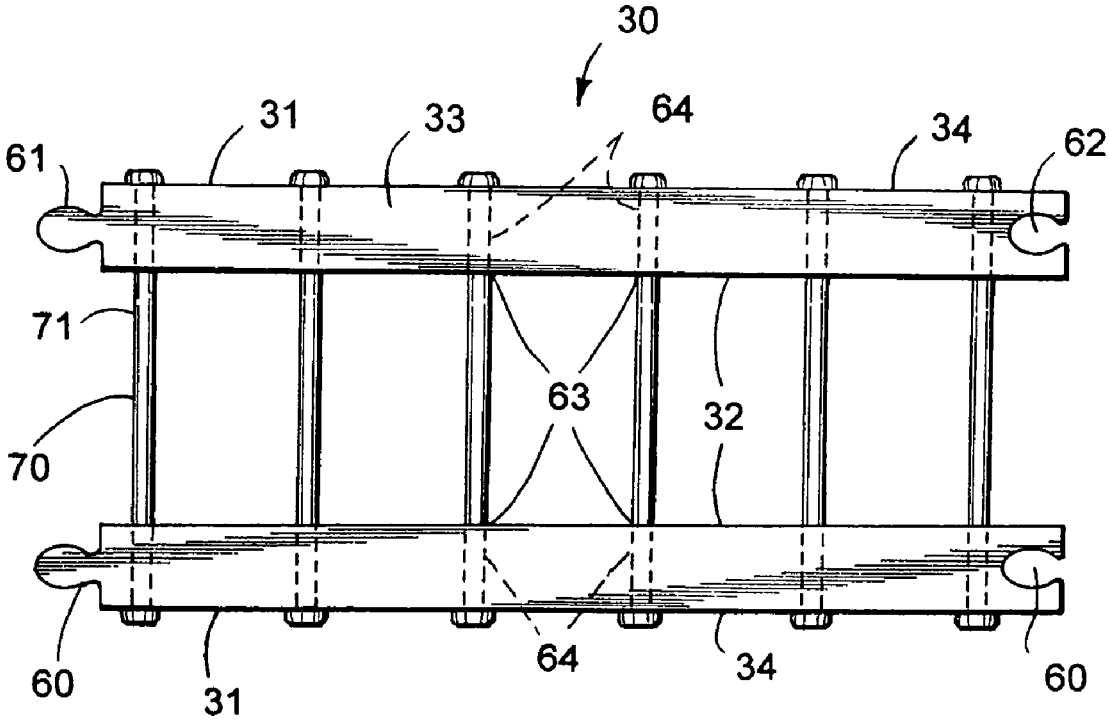
FIG. 2A shows a topside view of a straight track.

FIG. 2A shows a topside view of a straight track 30. Said straight track comprises two rigid, rectangular rails each rail 31 of substantially equal dimensions joined together by readily detachable steps 70. Each rail 31 comprises step insertion elements 63 located in whole or part at the interior side 32 of a rail into which a step 70 is inserted. An element 63 may accommodate the insertion of a step 70 into or through the interior side of the rail 32, the top side of the rail 33, or the exterior side of the rail 34. The drawing depicts a straight track 30 comprising two rigid, rectangular rails 31 joined together by readily detachable rungs 71, a type of step 70. Each rail 31 comprises square shaped rung insertion elements 64 into which a rungs 71 with squared closures 75 are inserted. The elements 64 bore through each rail 31 from the exterior side 34 to the interior side 32.

The straight track comprises elements 60 used to effect connections to a contiguous track or tracks, straight 30, arced 40, or curved 50, or to a distinct end coupler 90, thereby bridging the non-contiguous ends of tracks. The drawing depicts two interfitting male connections 61 in the shape of a tenon comprising the ends of each rail located at one end of the straight track and two interfitting female connections 62 in a shape corresponding to a recessed tenon comprising the ends of each rail located at the opposite end of the track.

The straight track is free of end boards as an element thereof removing an obstruction associated with prior art 23. The obstruction hinders entering or dismounting a track or traversing two connected tracks.

Figures 2B, 2C:
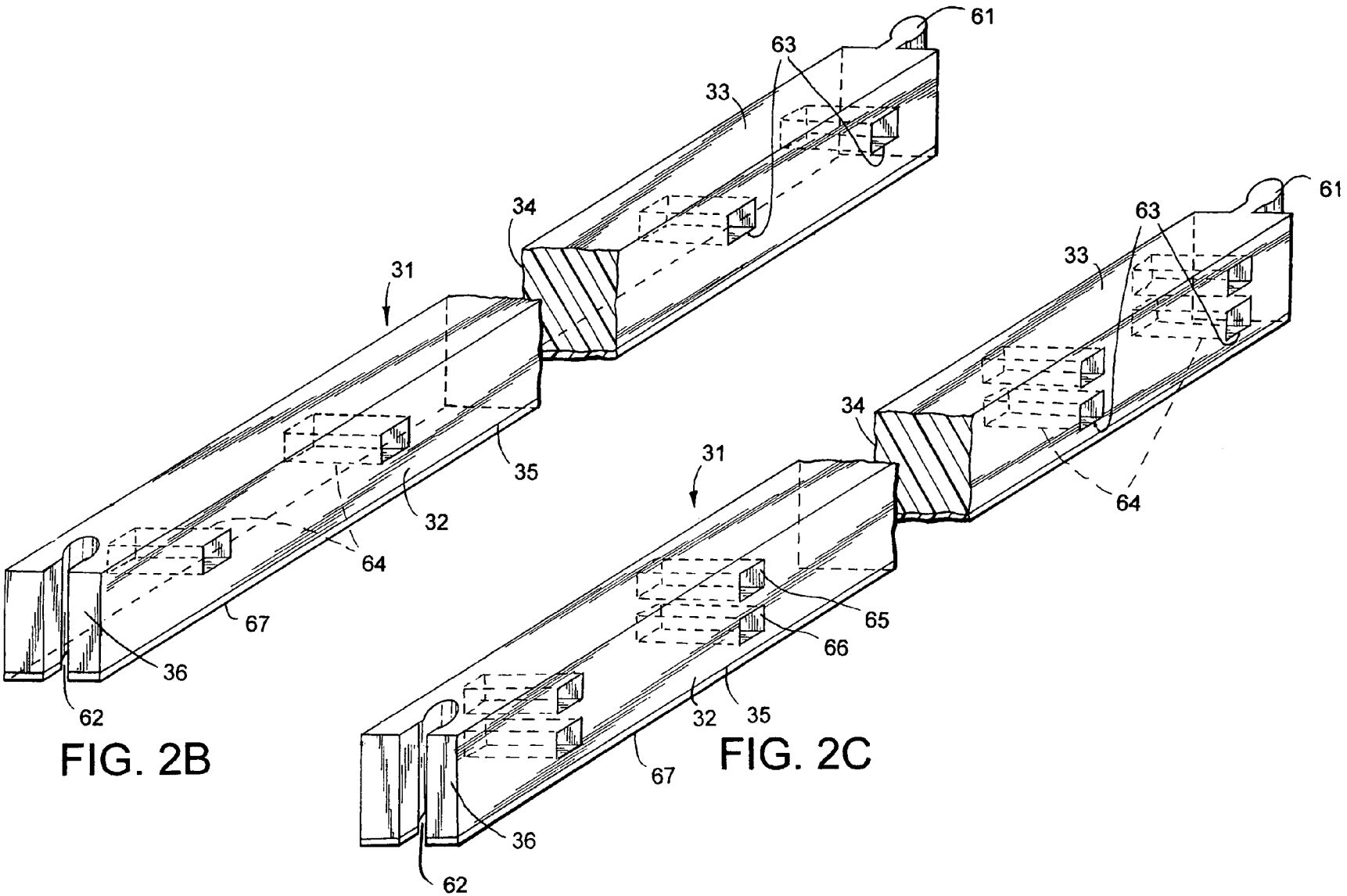
FIG. 2B shows a perspective view of a rectangular rail comprising a single row of elements located in whole or part at the interior side of the rail into or through which steps are inserted.
FIG. 2C shows a perspective view of a rectangular rail wherein said rail comprises two rows of elements located in whole or part at the interior side of the rail into or through which steps are inserted.

FIG. 2B shows a perspective view of a rectangular rail 31. Each rail comprises step insertion elements 63 located in whole or part at the interior side of the rail 32. An element 63 may accommodate the insertion of a step 70 into or through the interior side of the rail 32, the top side of the rail 33, or the exterior side of the rail 34. The drawing depicts a single row of square shaped rung insertion elements 64 that accommodate rungs 71 with squared closures 75. Said elements 64 bore through the rail from the exterior side 34 to the interior side 32.

The ends of each rectangular rail 36 are comprised of an interfitting male connection 61 in the shape of a tenon and an interfitting female connection 62 in a shape corresponding to a recessed tenon. These elements are used to effect connections with contiguous rails of tracks, straight 30, arced 40, or curved 50, or to a contiguous distinct end coupler 90, thereby bridging the non-contiguous rails of tracks.

The surface of the top side of a rectangular rail 33 may be may be smooth or semi-rough. An anti-slide element 67 is affixed to the bottom side of the rail 35.

Figure 3A:
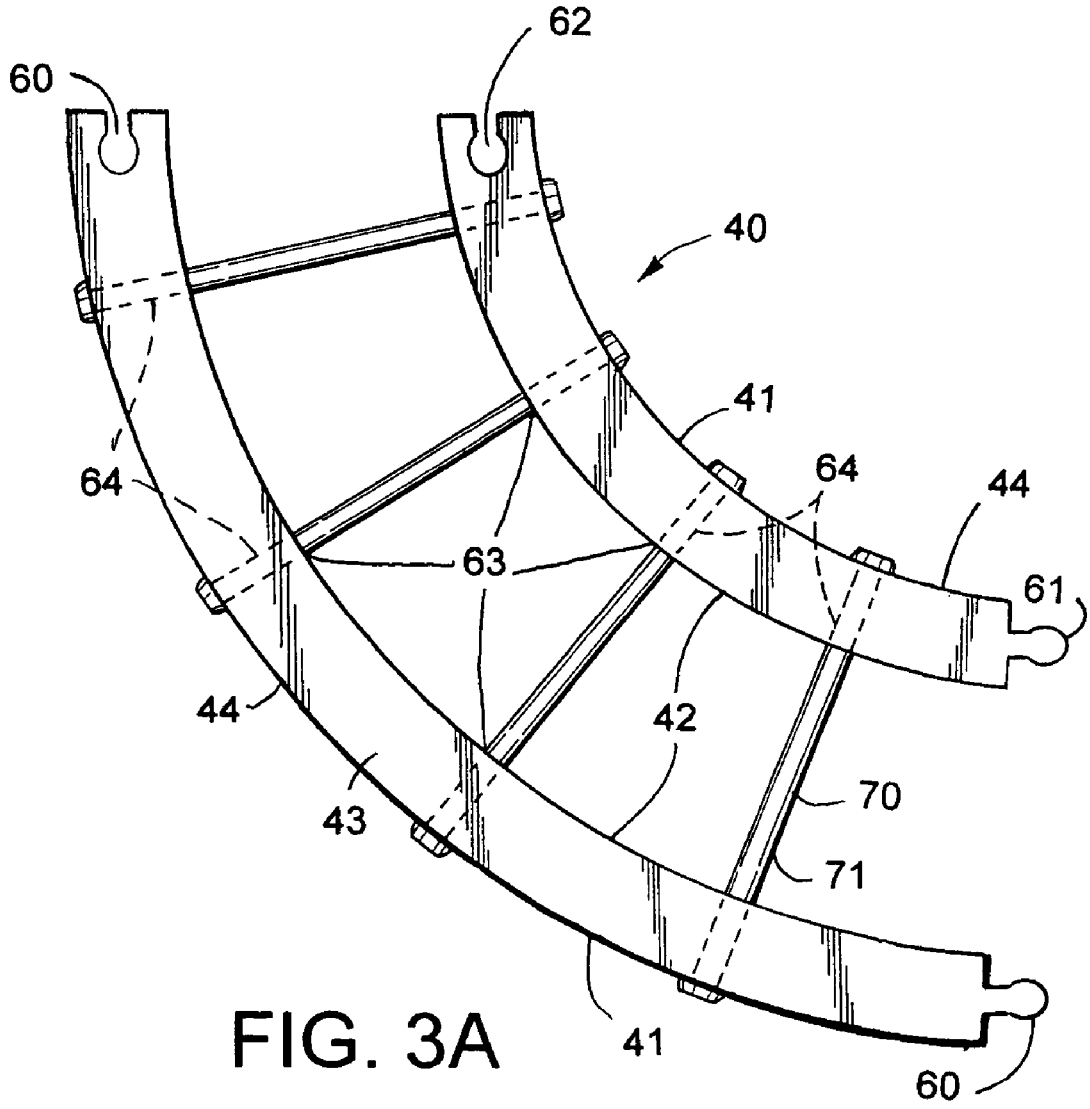
FIG. 3A shows a topside view of an arced track.

FIG. 3A shows a topside view of an arced track 40. Said arced track comprises two oblong, rigid, arced rails each rail 41 of substantially equal height and width joined together by readily detachable steps 70. Each rail 41 comprises step insertion elements 63 located in whole or part at the interior side 42 of a rail into which a step 70 is inserted. An element 63 may accommodate the insertion of a step 70 into or through the interior side of the rail 42, the top side of the rail 43, or the exterior side of the rail 44. The drawing depicts an arced track 40 comprising two rigid, arced rails 41 joined together by readily detachable rungs 71, a type of step 70. Each rail 41 comprises square shaped rung insertion elements 64 into which a rungs 71 with squared rung closures 75 are inserted. The elements 64 bore through each rail 41 from the exterior side 44 to the interior side 42.

The arced track comprises elements 60 used to effect connections to a contiguous track or tracks, straight 30, arced 40, or curved 50, or to a distinct end coupler 90, thereby bridging the non-contiguous ends of tracks. The drawing depicts two interfitting male connections 61 in the shape of a tenon comprising the ends of each rail located at one end of the arced track and two interfitting female connections 62 in a shape corresponding to a recessed tenon comprising the ends of each rail located at the opposite end of the track.

The arced track is free of end boards as an element thereof removing an obstruction associated with prior art 23. The obstruction hinders entering or dismounting a track or traversing two connected tracks.

Figure 3B:
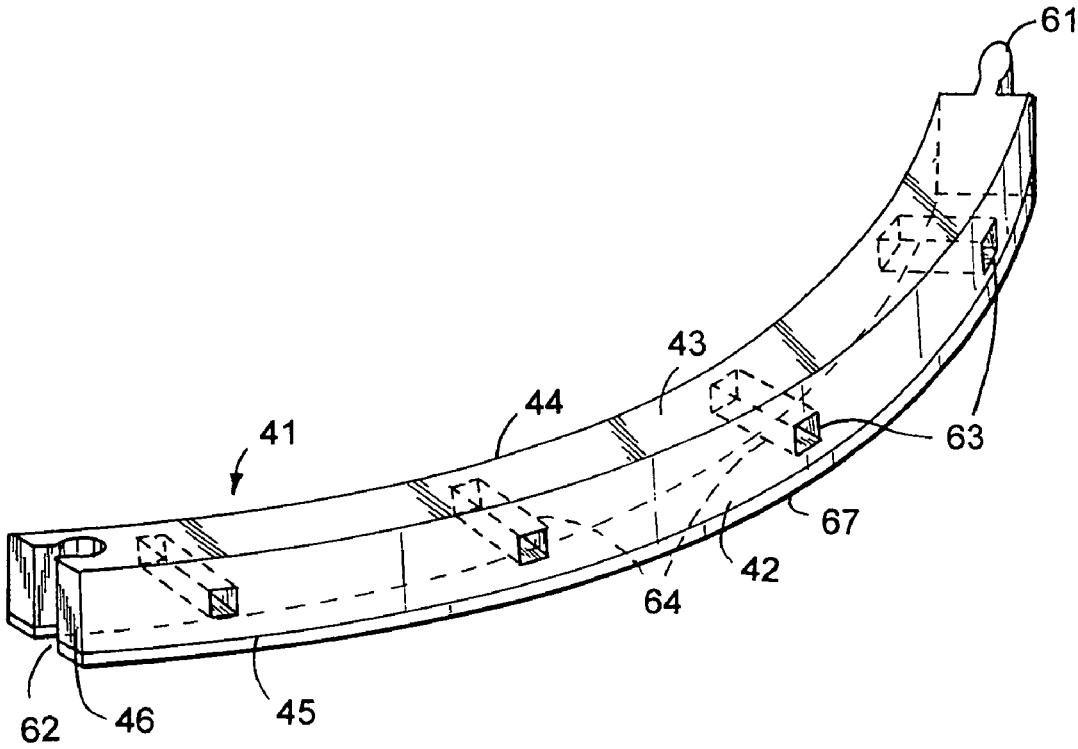
FIG. 3B shows a perspective view of an arced rail comprising a single row of elements located in whole or part at the interior side of the rail into or through which steps are inserted.

FIG. 3B shows a perspective view of an arced rail 41. Each rail comprises step insertion elements 63 located in whole or part at the interior side of the rail 42. An element 63 may accommodate the insertion of a step 70 into or through the interior side of the rail 42, the top side of the rail 43, or the exterior side of the rail 44. The drawing depicts a single row of square shaped rung insertion elements 64 that accommodate rungs 71 with squared closures 75. Said elements 64 bore through the rail from the exterior side 44 to the interior side 42.

The ends of each arced rail 46 are comprised of an interfitting male connection 61 in the shape of a tenon and an interfitting female connection 62 in a shape corresponding to a recessed tenon. These elements are used to effect connections with contiguous rails of tracks, straight 30, arced 40, or curved 50, or to a contiguous distinct end coupler 90, thereby bridging the non-contiguous rails of tracks.

The surface of the top side of an arced rail 43 may be smooth or semi-rough. An anti-slide element 67 is affixed to the bottom side of the arced rail 45.

Figure 4A:
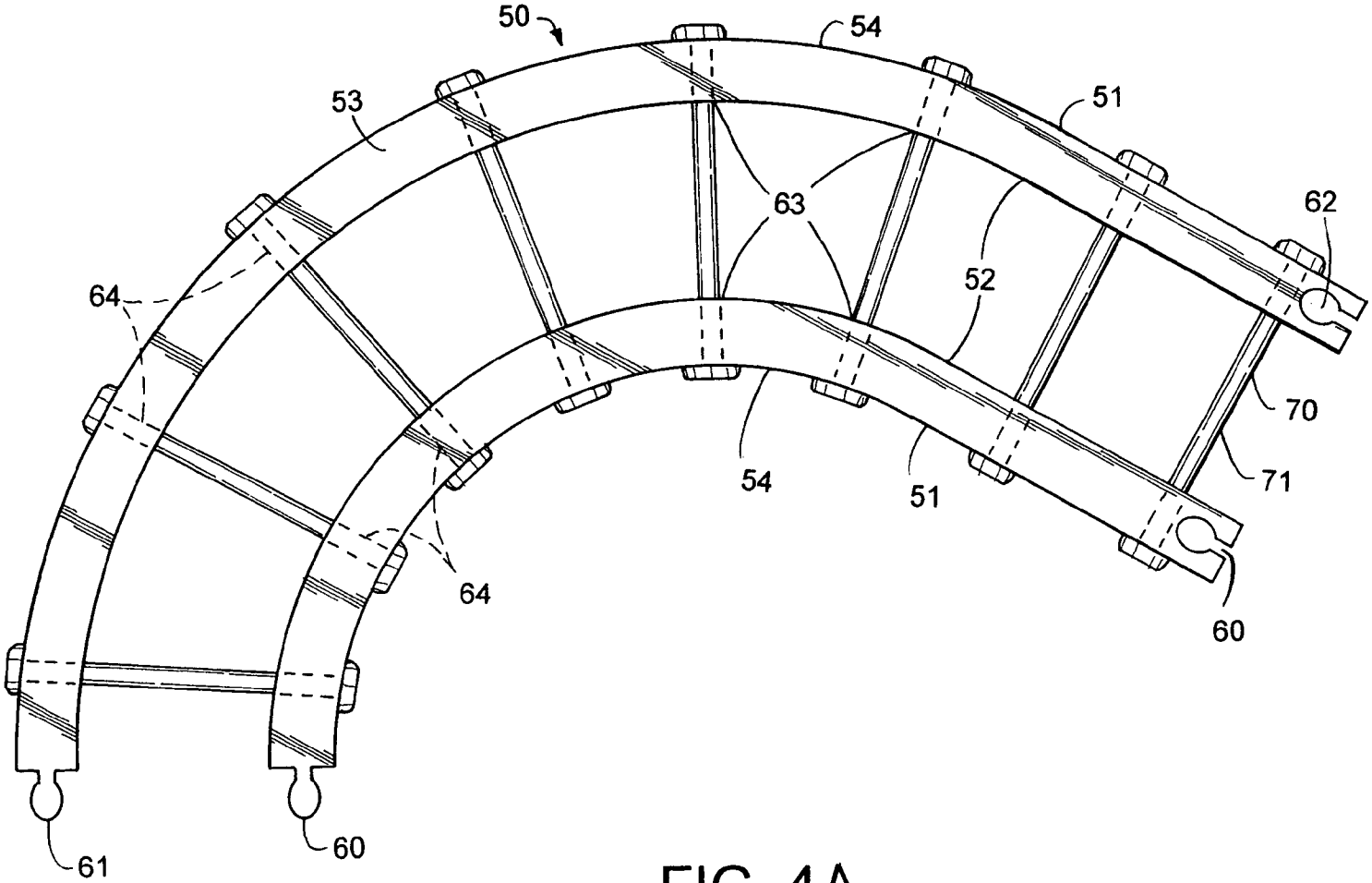
FIG. 4A shows a topside view of a curved track.

FIG. 4A shows a topside view of a curved track 50. Said curved track comprises two oblong, rigid, curved rails each rail 51 of substantially equal height and width joined together by readily detachable steps 70. Each rail 51 comprises step insertion elements 63 located in whole or part at the interior side 52 of a rail into which a step 70 is inserted. An element 63 may accommodate the insertion of a step 70 into or through the interior side of the rail 52, the top side of the rail 53, or the exterior side of the rail 54. The drawing depicts a curved track 50 comprising two rigid, curved rails 51 joined together by readily detachable rungs 71, a type of step 70. Each rail 51 comprises square shaped rung insertion elements 64 into which a rungs 71 with squared closures 75 are inserted. The elements 64 bore through each rail 51 from the exterior side 54 to the interior side 52.

The curved track comprises elements 60 used to effect connections to a contiguous track or tracks, straight 30, arced 40, curved 50, or to a distinct end coupler 90, thereby bridging the non-contiguous ends of tracks. The drawing depicts two interfitting male connections 61 in the shape of a tenon comprising the ends of each rail located at one end of the curved track and two interfitting female connections 62 in a shape corresponding to a recessed tenon comprising the ends of each rail located at the opposite end of the track.

The curved track is free of end boards as an element thereof removing an obstruction associated with prior art 23. The obstruction hinders entering or dismounting a track or traversing two connected tracks.

Figure 4B:
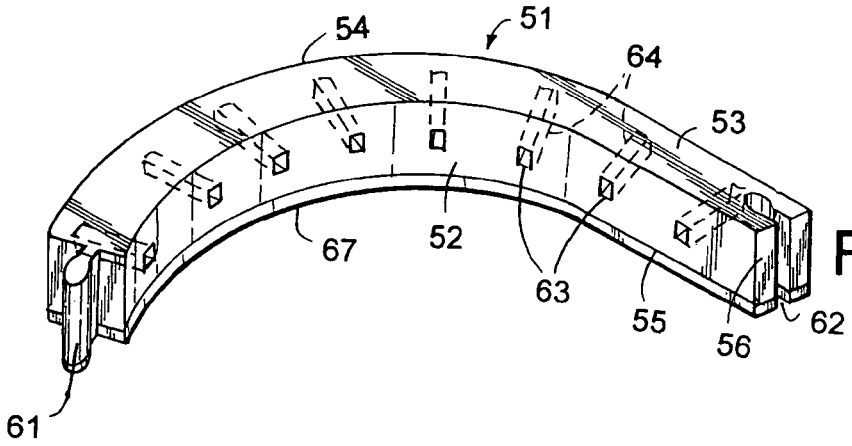
FIG. 4B shows a perspective view of a curved rail comprising a single row of elements located in whole or part at the interior side of the rail into or through which steps are inserted.

FIG. 4B shows a perspective view of a curved rail 51. Each rail comprises step insertion elements 63 located in whole or part at the interior side of the rail 52. An element 63 may accommodate the insertion of a step 70 into or through the interior side of the rail 52, the top side of the rail 53, or the exterior side of the rail 54. The drawing depicts a single row of square shaped rung insertion elements 64 that accommodate rungs 71 with squared closures 75. Said elements 64 bore through the rail from the exterior side 54 to the interior side 52.

The ends of each curved rail 56 are comprised of an interfitting male connection 61 in the shape of a tenon and an interfitting female connection 62 in a shape corresponding to a recessed tenon. These elements are used to effect connections with contiguous rails of tracks, straight 30, arced 40, or curved 50, or to a contiguous distinct end coupler 90, thereby bridging the non-contiguous rails of tracks.

The surface of the top side of a curved rail 53 may be smooth or semi-rough. An anti-slide element 67 is affixed to the bottom side of the curved rail 55.

Figure 5A:
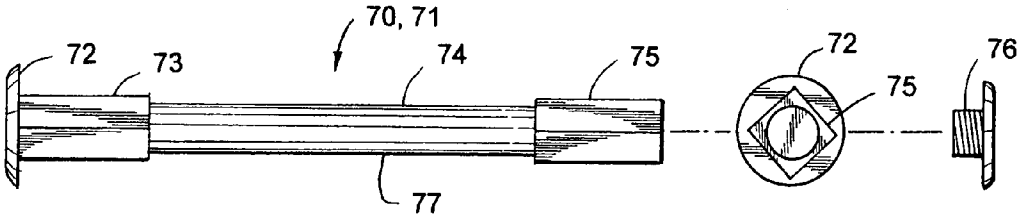
FIG. 5A shows a perspective view of a readily detachable rung with an oval shaped colored footing.
Figure 5B:
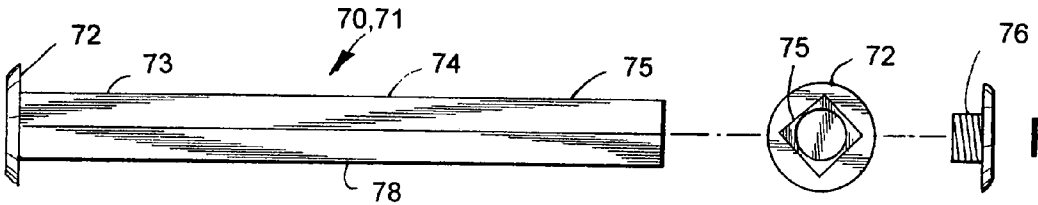
FIG. 5B shows a perspective view of a readily detachable rung with a rectangular shaped colored footing.
Figure 5C:
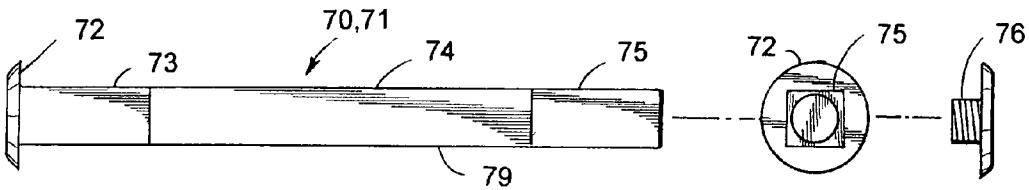

FIGS. 5A, 5B, and 5C show perspective views of rungs 71, a type of step 70, with oval 77, rectangular 78, and triangular 79 shaped colored footings, respectively. Each rung comprises an affixed flange 72 on the end of a first squared rung closure 73, a geometrically shaped footing 74, a second squared rung closure with a threaded female fastener 75, and a threaded male flanged fastener 76 that is screwed into the second squared rung closure 75. Each rung 71 is of substantially equal length and, when secured to the rails, of substantially equal height.

The preferred embodiment of the invention further includes additional features described below. Each additional feature is represented in a dependent claim identified in Claims 2 through 8 and shown in FIGS. 2C, 3C, 4C, 6A, 7A, 7B, 7C, 8, 9, 10, 11, or 12.

FIG. 2C shows a perspective view of a rectangular rail 31 wherein said rectangular rail comprises step insertion elements 63 located in whole or part at the interior side of the rail 32 in a pattern that permits the steps to be varied in height. An element 63 may accommodate the insertion of a step 70 into the interior side of the rail 32, the top side of the rail 33, or the exterior side of the rail 34. The drawing depicts two rows of square shaped rung insertion elements 64 that accommodate rungs 71 with squared closures 75. The upper row of elements 65 is located directly over the lower row of elements 66. Insertion of a rung 71 into an element 64 located on either the upper 65 or lower 66 row and into the corresponding element 64 of the opposing rail results in the height of the rungs being varied. Said elements 64 bore through the rail from the exterior side 34 to the interior side 32. In all other respects, this rectangular rail is identical to the rectangular rail shown in FIG. 2B.

Figure 3C:
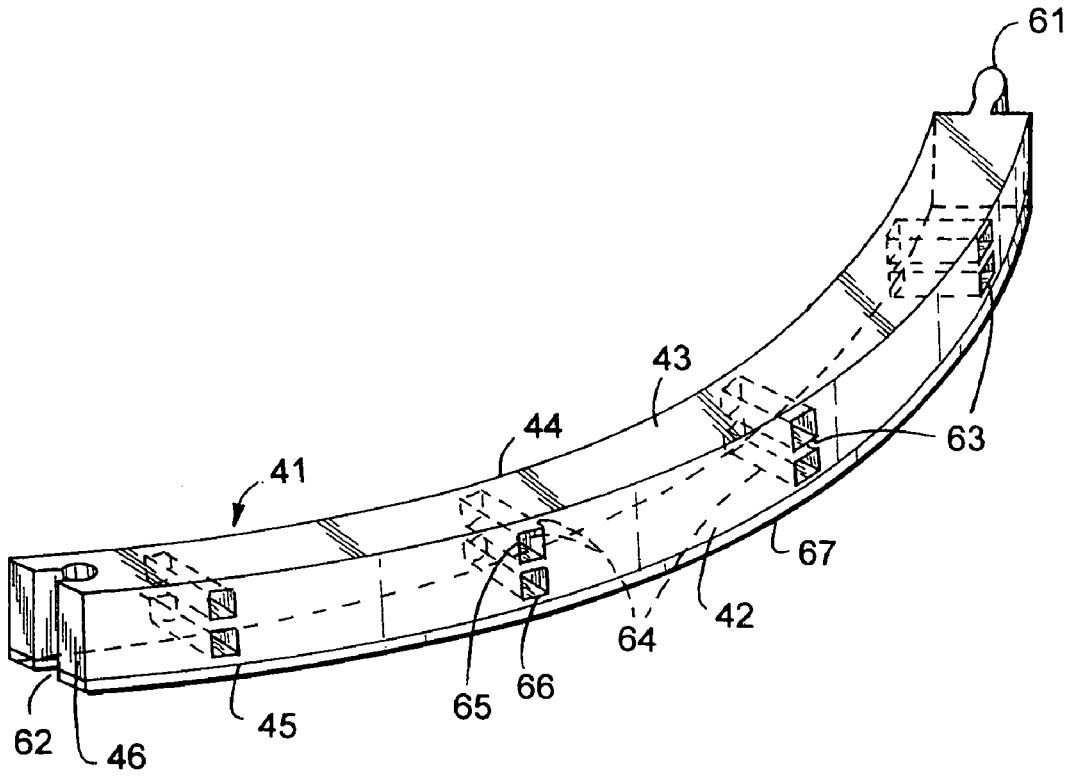
FIG. 3C shows a perspective view of an arced rail wherein said rail comprises two rows of elements located in whole or part at the interior side of the rail into or through which steps are inserted.

FIG. 3C shows a perspective view of an arced rail 41 wherein said arced rail comprises step insertion elements 63 located in whole or part at the interior side of the rail 42 in a pattern that permits the steps to be varied in height. An element 63 may accommodate the insertion of a step 70 into the interior side of the rail 42, the top side of the rail 43, or the exterior side of the rail 44. The drawing depicts two rows of square shaped rung insertion elements 64 that accommodate rungs 71 with squared closures 75. The upper row of elements 65 is located directly over the lower row of elements 66. Insertion of a rung 71 into an element 64 located on either the upper 65 or lower 66 row and into the corresponding element 64 of the opposing rail results in the height of the rungs being varied. Said elements 64 bore through the rail from the exterior side 44 to the interior side 42. In all other respects, this arced rail is identical to the arced rail shown in FIG. 3B.

Figure 4C:
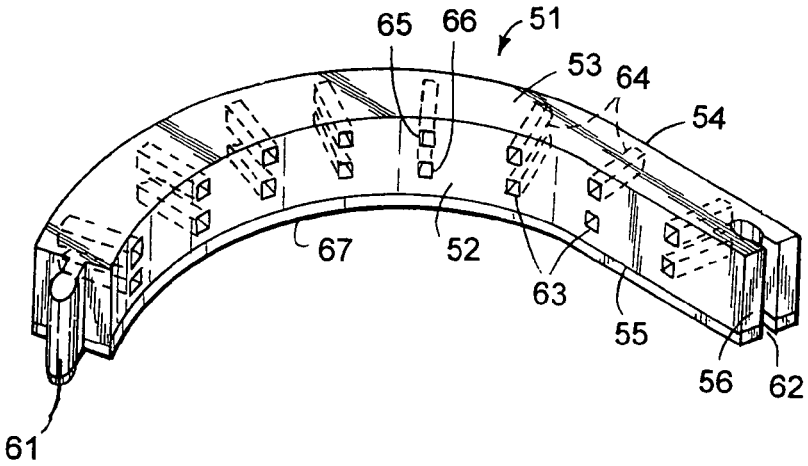
FIG. 4C shows a perspective view of a curved rail wherein said rail comprises two rows of elements located in whole or part at the interior side of the rail into or through which steps are inserted.

FIG. 4C shows a perspective view of a curved rail 51 wherein said curved rail comprises step insertion elements 63 located in whole or part at the interior side of the rail 52 in a pattern that permits the steps to be varied in height. An element 63 may accommodate the insertion of a step 70 into the interior side of the rail 52, the top side of the rail 53, or the exterior side of the rail 54. The drawing depicts two rows of square shaped rung insertion elements 64 that accommodate rungs 71 with squared closures 75. The upper row of elements 65 is located directly over the lower row of elements 66. Insertion of a rung 71 into an element 64 located on either the upper 65 or lower 66 row and into the corresponding element 64 of the opposing rail results in the height of the rungs being varied. Said elements 64 bore through the rail from the exterior side 54 to the interior side 52. In all other respects, this curved rail is identical to the curved rail shown in FIG. 4B.

Figure 6A:
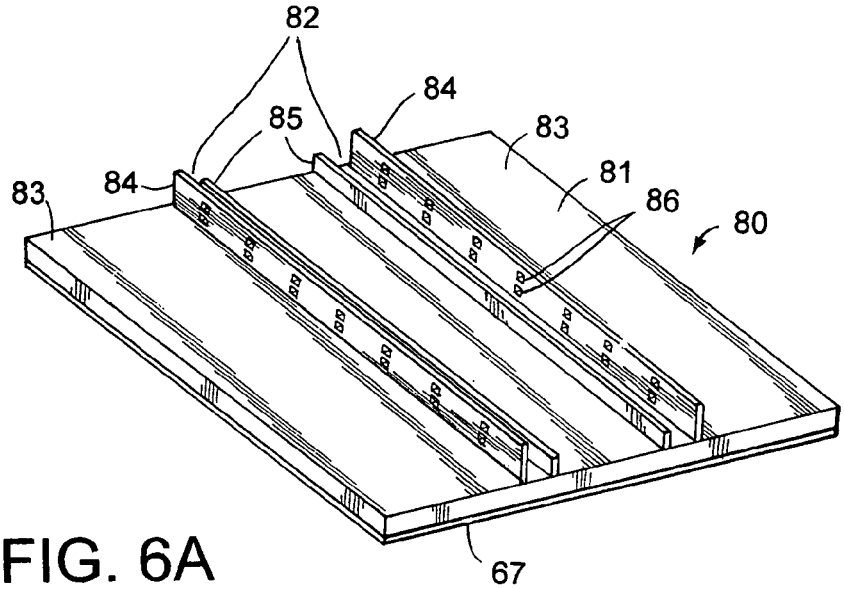
FIG. 6A shows a perspective view of an anti-tip device.

The preferred embodiment of the invention further includes an anti-tip device 80 for use with a straight track 30. FIG. 6A shows a perspective view of said anti-tip device. The anti-tip device comprises an elongated, rectangular shaped planar surface 81 and two work holder areas 82. Each work holder area is in the shape of a rectangular rail 31 and bordered by two raised elongated work stop abutments, a tall exterior work stop abutment 84 comprising step insertion elements 86 and a shorter interior work stop abutment 85. The drawing depicts square shaped rung insertion elements 87. The anti-tip element 83 is comprised of the portions of the planar surface 81 extending out from each exterior work stop abutment 84. An anti-slide element 67 is affixed to the bottom side of the anti-tip device.

Figure 7A:
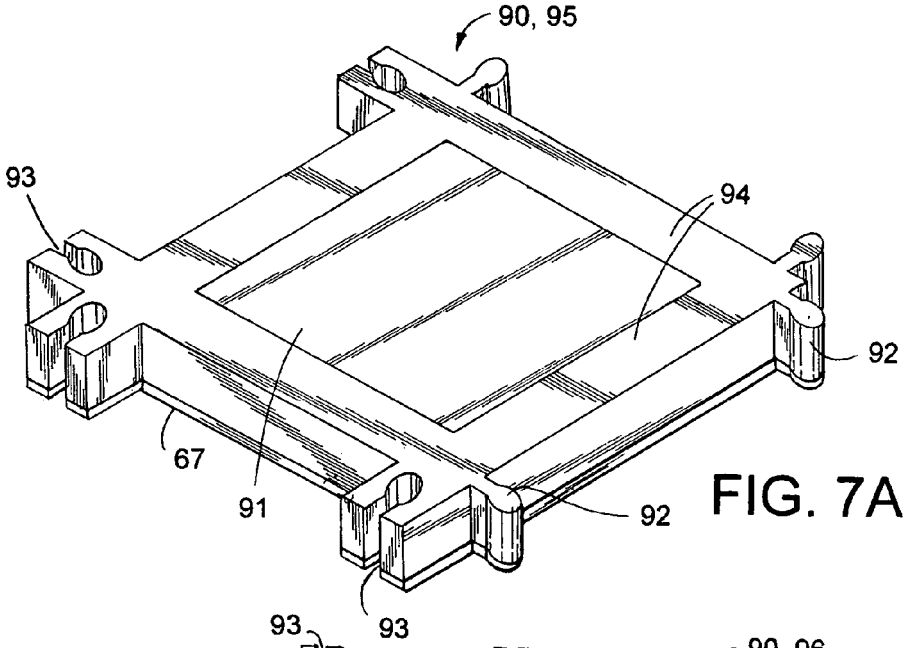
FIG. 7A shows a perspective view of a distinct end coupler comprising a diamond shaped planar surface.
Figure 7B:
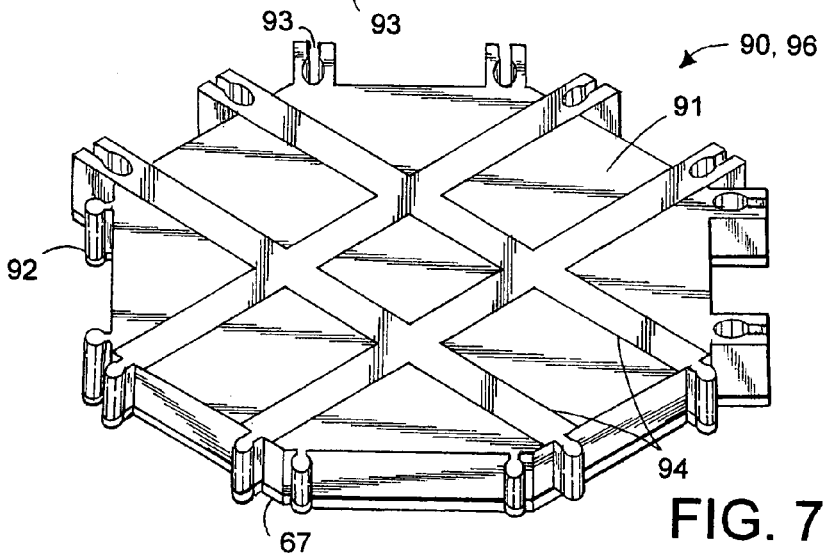
FIG. 7B shows a perspective view of a distinct end coupler comprising an octagon shaped planar surface.
Figure 7C:
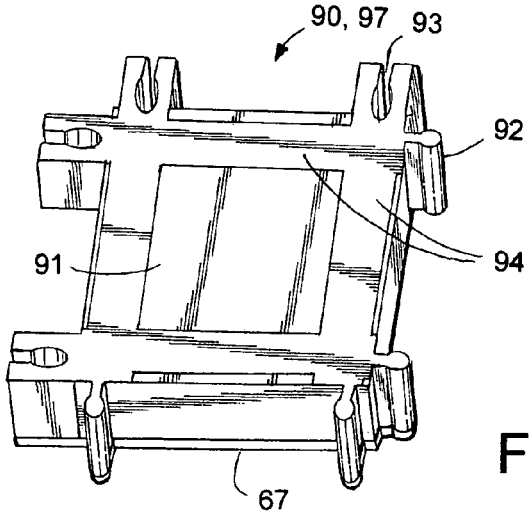
FIG. 7C shows a perspective view of a distinct end coupler comprising a rectangular shaped planar surface.

The preferred embodiment of the invention further includes a geometrically shaped distinct end coupler 90. FIG. 7A shows a perspective view of a diamond shaped distinct end coupler 95. FIG. 7B shows a perspective view of an octagon shaped distinct end coupler 96. FIG. 7C shows a perspective view of a rectangular shaped distinct end coupler 97. Each distinct end coupler 90 comprises a planar surface 91 comprising elongated stripes 94 connecting the non-contiguous ends of two tracks in a visual sense. Each side of a distinct end coupler comprises either two interfitting male connections 92 in the shape of a tenon or two interfitting female connections 93 in a shape corresponding to a recessed tenon. These elements are used to effect connections with one or more contiguous tracks, straight 30, arced 40, or curved 50, thereby bridging non-contiguous tracks. An anti-slide element 67 is affixed to the bottom side of each distinct end coupler.

The preferred embodiment of the invention further includes various design apparatuses each apparatus traversed horizontally by a human. Said apparatuses are shown in FIGS. 8, 9, 10, 11, and 12. Each apparatus comprises a straight track 30 or tracks, an arced track 40 or tracks, or a curved track 50 or tracks, or a combination thereof. Each track comprising an apparatus is connected to one or more contiguous tracks or to a distinct end coupler 90, thereby bridging the non-contiguous ends of tracks.

Figure 8:
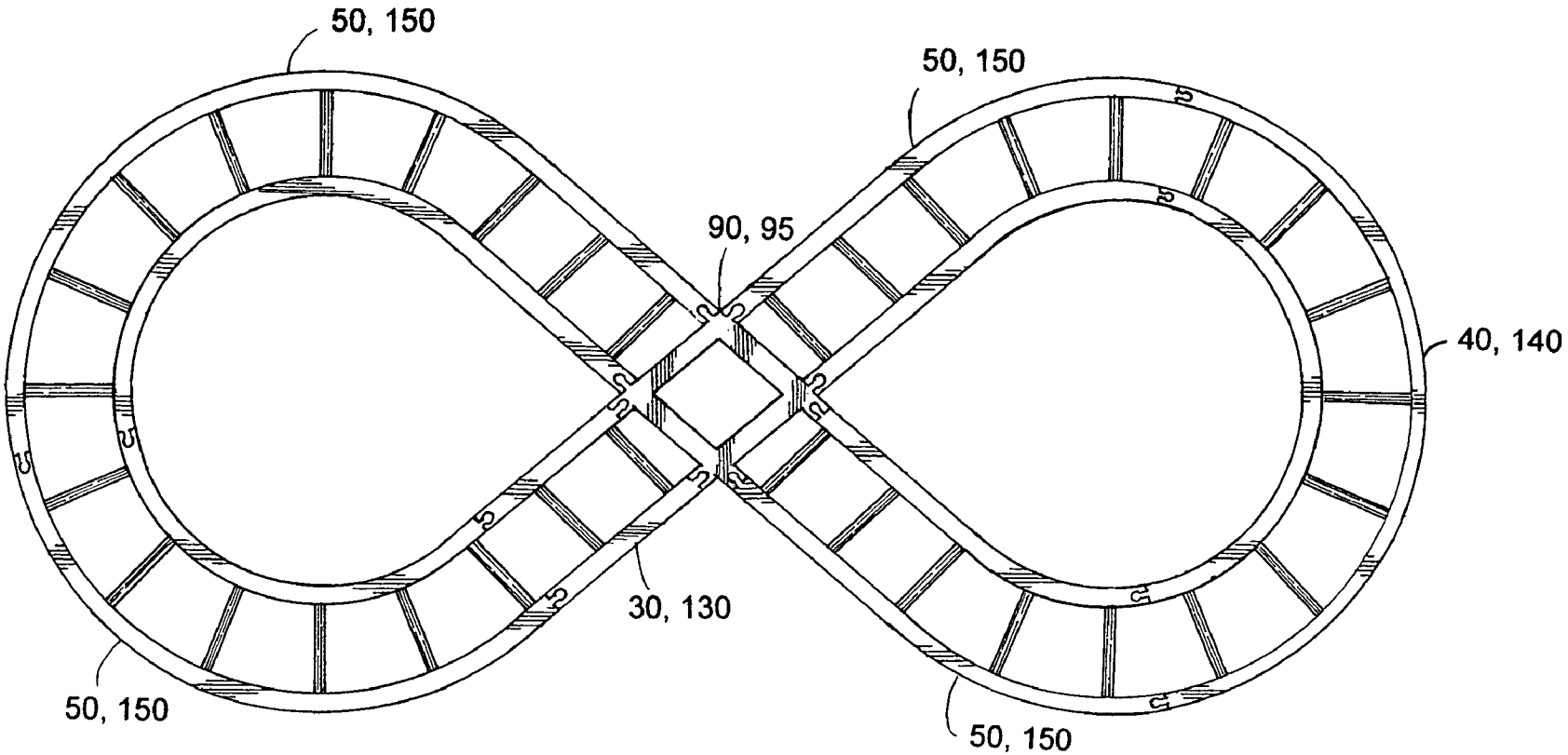
FIG. 8 shows a top side view of tracks comprising the design of a figure eight lying on its side using a diamond shaped distinct end coupler.

FIG. 8 shows a topside view of the preferred embodiment of the invention in the design of a figure eight lying on its side. The apparatus is comprised of tracks contiguously connected and a diamond shaped distinct end coupler 95 used as a bridge to connect the non-contiguous ends of tracks. The distinct end coupler is located at the center of the apparatus.

Figure 9:
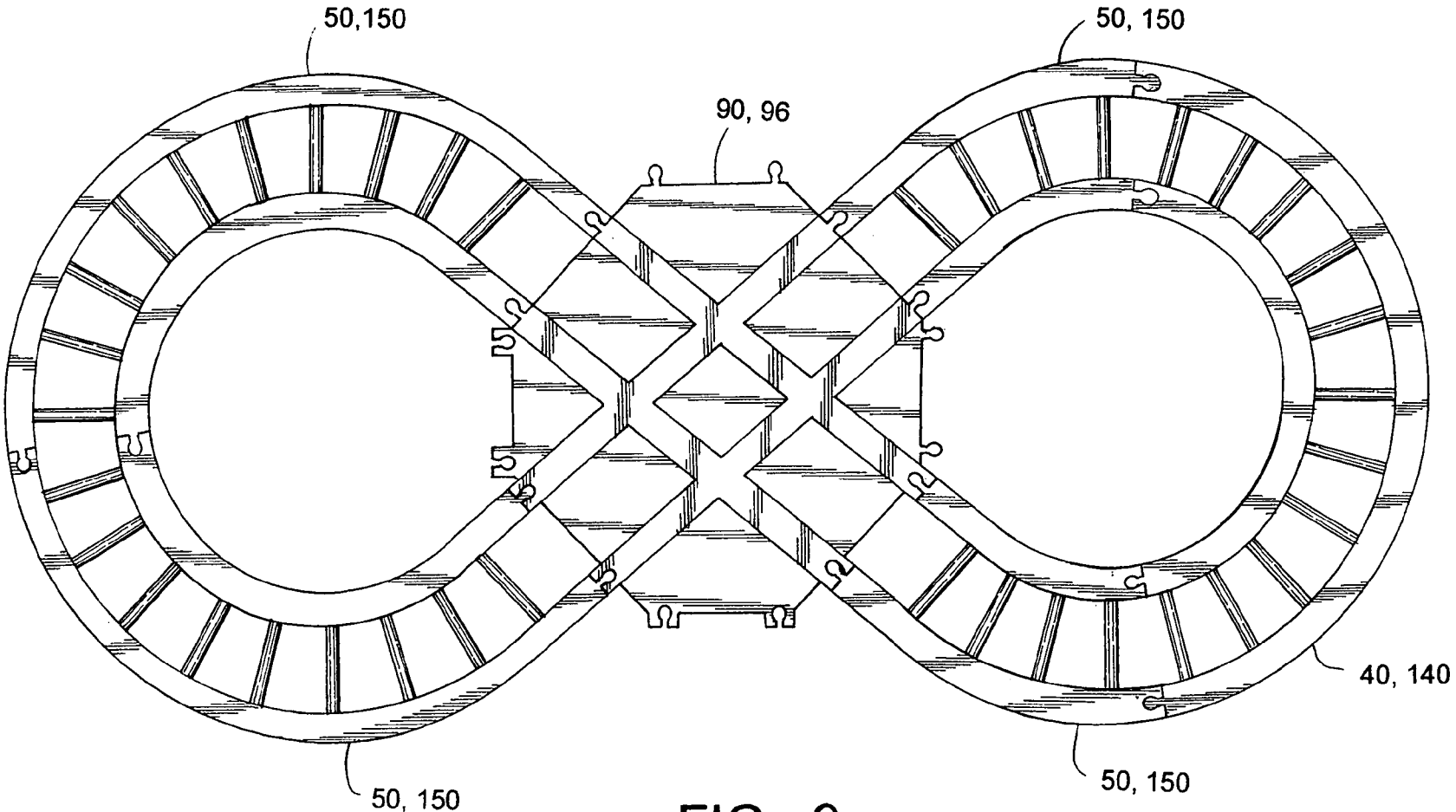
FIG. 9 shows a top side view of tracks comprising the design of a figure eight lying on its side using an octagon shaped distinct end coupler.

FIG. 9 shows a topside view of the preferred embodiment of the invention in the design of a figure eight lying on its side. The apparatus is comprised of tracks contiguously connected and an octagon shaped distinct end coupler 96 used as a bridge to connect the non-contiguous ends of tracks. The distinct end coupler is located at the center of the apparatus.

Figure 10:
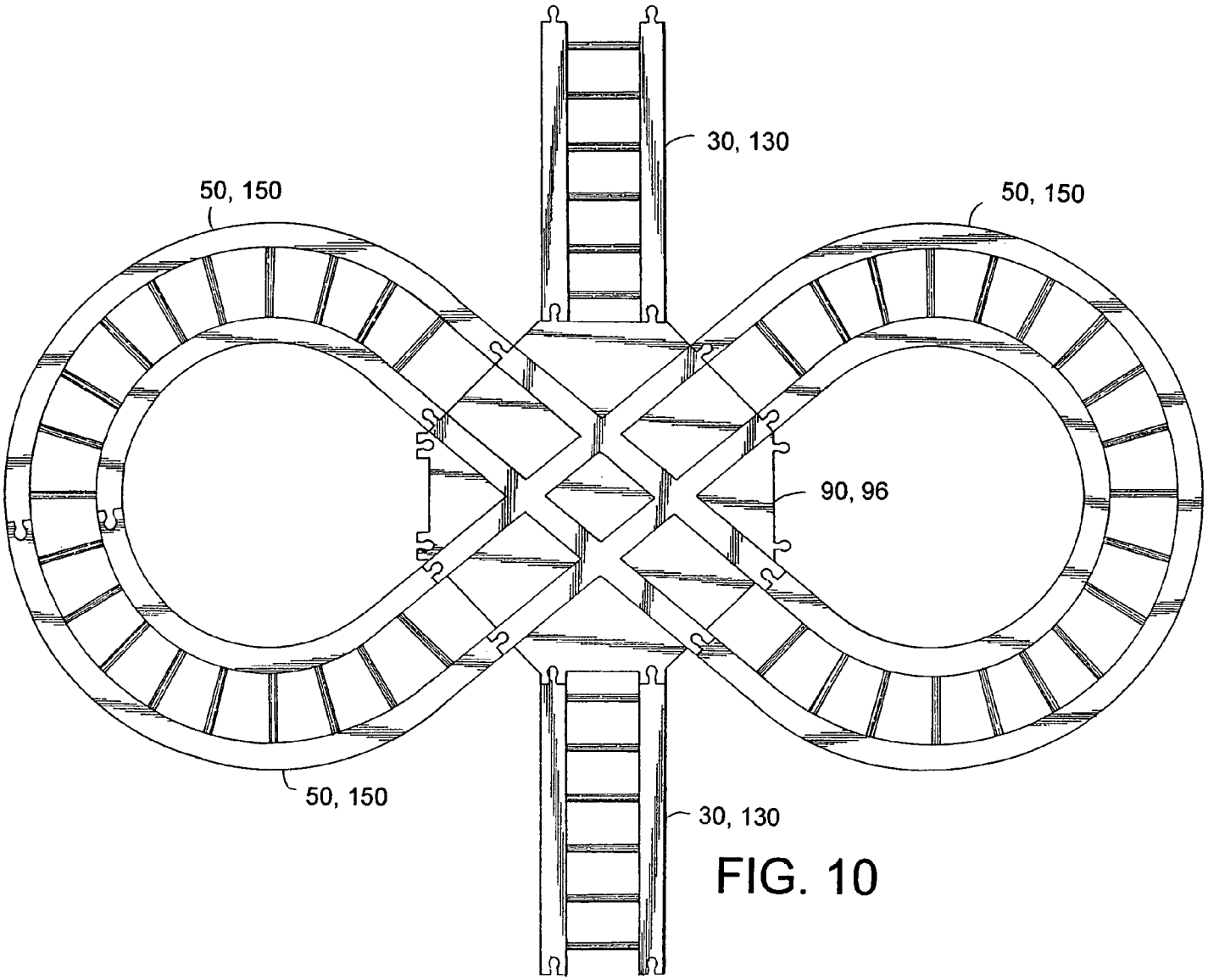
FIG. 10 shows a top side view of tracks comprising the design of a figure eight lying on its side longitudinally intersected at its center by a column of straight tracks using an octagon shaped distinct end coupler.

FIG. 10 shows a topside view of the second embodiment of the invention in the design of a figure eight lying on its side longitudinally intersected at its center by a column of straight tracks. The apparatus is comprised of tracks contiguously connected and an octagon shaped distinct end coupler 96 used as a bridge to connect the non-contiguous ends of tracks, including the column of straight tracks 130. The distinct end coupler is located at the center of the apparatus.

Figure 11:
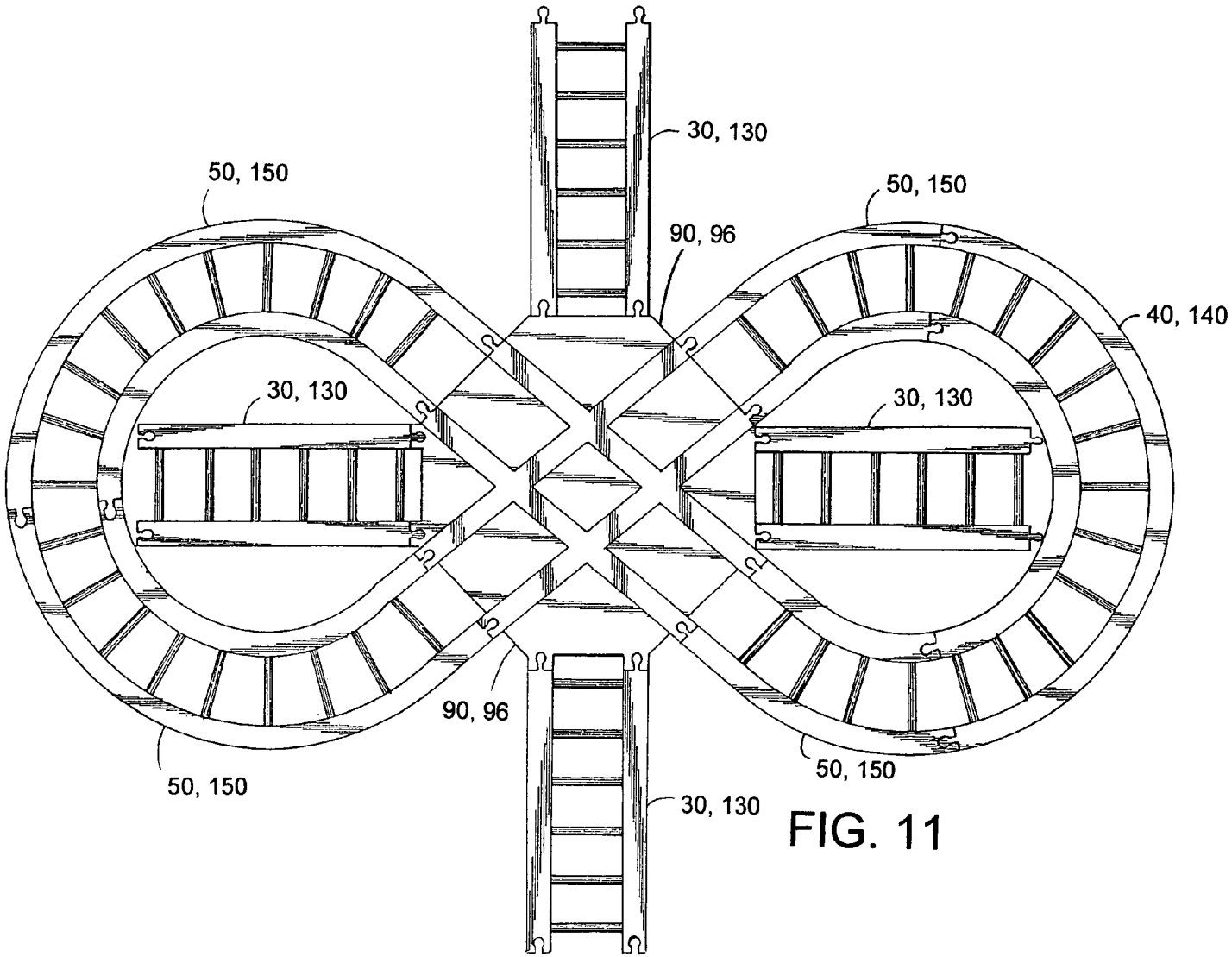
FIG. 11 shows a topside view of tracks comprising the design of a figure eight lying on its side longitudinally and laterally intersected at its center by a column and a row of straight tracks using an octagon shaped distinct end coupler.

FIG. 11 shows a topside view of the second embodiment of the invention in the design of a figure eight lying on its side longitudinally and laterally intersected at its center by a column and row of straight tracks. The apparatus is comprised of tracks contiguously connected and an octagon shaped distinct end coupler 96 used as a bridge to connect the non-contiguous ends of tracks, including the column and row of straight tracks 130. The distinct end coupler is located at the center of the apparatus.

Figure 12:
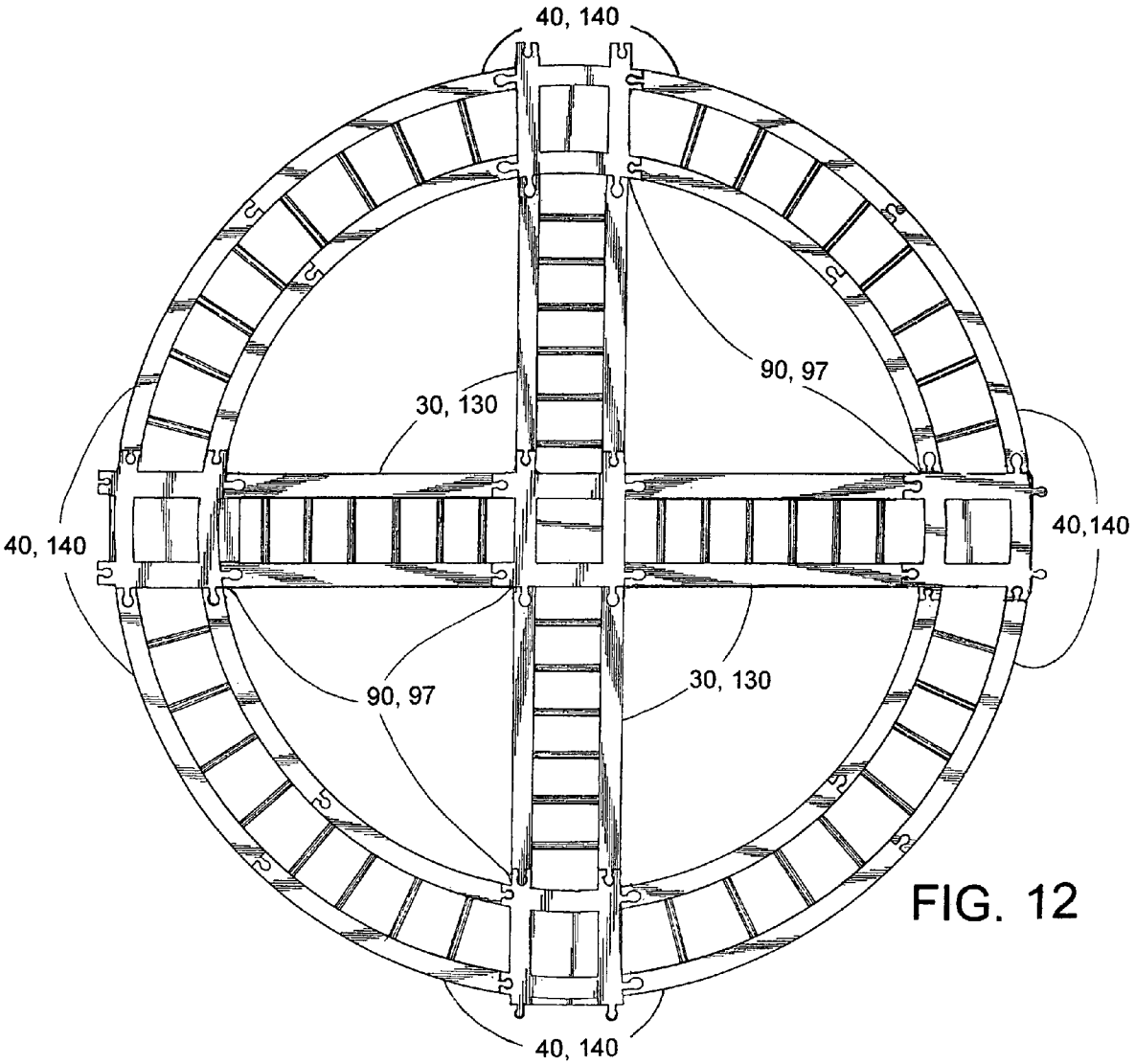
FIG. 12 shows a topside view of tracks comprising the design of a circle enclosing a plus sign using rectangular shaped distinct end couplers.

FIG. 12 shows a topside view of the preferred embodiment of an apparatus in the design of a circle enclosing a plus sign. Each arced track 40 comprising the circle is connected to one or more contiguous arced tracks or connected to one or more tracks, straight or arced, with the aid of a rectangular shaped distinct end coupler 97. Each straight track 30 comprising the plus sign is connected to one or more contiguous straight tracks or connected to one or more tracks, straight or arced, with the aid of a rectangular shaped distinct end coupler 97. A distinct end coupler 97 is located at the center of the plus sign bridging the non-contiguous ends of four straight tracks. Four distinct end couplers 97 are located at the ends of the plus sign each distinct end coupler intersecting and connecting with the circle of arced tracks bridging the non-contiguous ends of straight and arced tracks.

Operation—Preferred Embodiment

1. Traversing a Track, Tracks, or an Apparatus

The preferred embodiment of the invention is an article of educational equipment horizontally traversed by a human. The invention comprises tracks, straight 30, arced 40, or curved 50. A single track may be traversed. A track may be connected to a contiguous track or tracks, straight, arced, or curved, and the combination of tracks traversed. A track may be connected to a contiguous distinct end coupler 90 bridging one end of the track to the end of a non-contiguous track or tracks, straight, arced, or curved. The combination of tracks and the distinct end coupler are then traversed. Contiguous tracks and tracks with the aid of one or more distinct end couplers may be joined together to create an apparatus in a design shown in FIGS. 8, 9, 10, 11, or 12. The apparatus is then traversed.

A human may traverse the geometrically shaped colored footings of the steps 70 of a track, straight, arced, or, curved, or walk upon the top side of either rail using the rail as a balance beam. The distance between the steps 70 may be adjusted to accommodate the stride of a human. The height of each step 70 is substantially the same if the rails comprising the track comprise level step insertion elements 63. The height of each step may vary if the rails comprising the track comprise step insertion elements 63 that are not level. The ability to adjust the height of the steps 70 increases the level of difficulty associated with traversing a track. An anti-slide element 67 is affixed to the bottom sides of each rail, distinct end coupler 90, and anti-tip device 80 preventing a track from shifting while under foot.

In addition to bridging the non-contiguous ends of tracks, a distinct end coupler 90 is used as an agent to traverse from one track to another. The planar surface 91 comprises elongated stripes 94 visually connecting non-contiguous ends of tracks thereby assisting a traversing human. A distinct end coupler is also used as a station on which a human stands while receiving instructions prior to traversing a track or apparatus.

An anti-tip device 80 may be employed to prevent tipping of a straight track 30 while under foot. An anti-tip device provides protection in two ways. First, an anti-tip element 83 is comprised of the portions of the elongated, rectangular planar surface 81 that extend out from each exterior work stop abutment 84. Second, the sides of each rectangular rail 31 lie adjacent to the exterior 84 and interior 85 work stop abutments gaining support. Additionally, each rail may be attached to the exterior work stop abutment 84 if the steps 70 are inserted through step insertion elements 86 comprising the abutment 84.

2. Assembling a Track

A track, straight 30, arced 40, or curved 50, is assembled by placing the bottom side of each rail on a flat surface directly opposite one another. To join the rails, readily detachable steps 70 are inserted into opposing step insertion elements 63 located in whole or part at the interior side of each rail. Each drawing in FIGS. 2A, 3A, and 4A depicts a track, straight 30, arced 40, or curved 50, comprising two rails joined together by readily detachable rungs 71. Each drawing in FIGS. 2B, 3B, and 4B depicts a rail, rectangular 31, arced 41, or curved 51, comprising a single row of square shaped rung insertion elements 64 located in whole or part at the interior side of each rail that accommodate rungs 71 with squared closures 75. A rung 71 is inserted into the exterior side of a rail and pushed through the rail exiting its interior side and subsequently inserted into the opposite rail at its interior side and pushed through the rail exiting its exterior side whereupon the rung is secured by means of a threaded male flanged fastener 76 screwed into the squared rung closure 75.

Each drawing in FIGS. 2C, 3C, and 4C depicts a rail comprising two rows of square shaped rung insertion elements 64 located in whole or part at the interior side of each rail that accommodate rungs 71 with squared closures 75. The upper row of elements 65 is directly over the lower row 66. A rung is perpendicularly inserted into or through an element 64 located on either the upper row 65 or lower row 66 of a rail and subsequently inserted into the corresponding row of the opposing rail. The height of the rung steps may be varied. Otherwise, the method of installing or removing rungs is the same as that described in the above paragraph for a rail with a single row of elements 64.

After the steps 70 are secured and the track assembled, the steps are positioned length-wise in a perpendicular or diametrical relationship to each rail, are incapable of rotating or shifting horizontally, and serve to hold the rails in a fixed equidistant relationship to each other. Each readily detachable step 70 may be installed or removed without the necessity of dismantling a track.

Figure 6B:
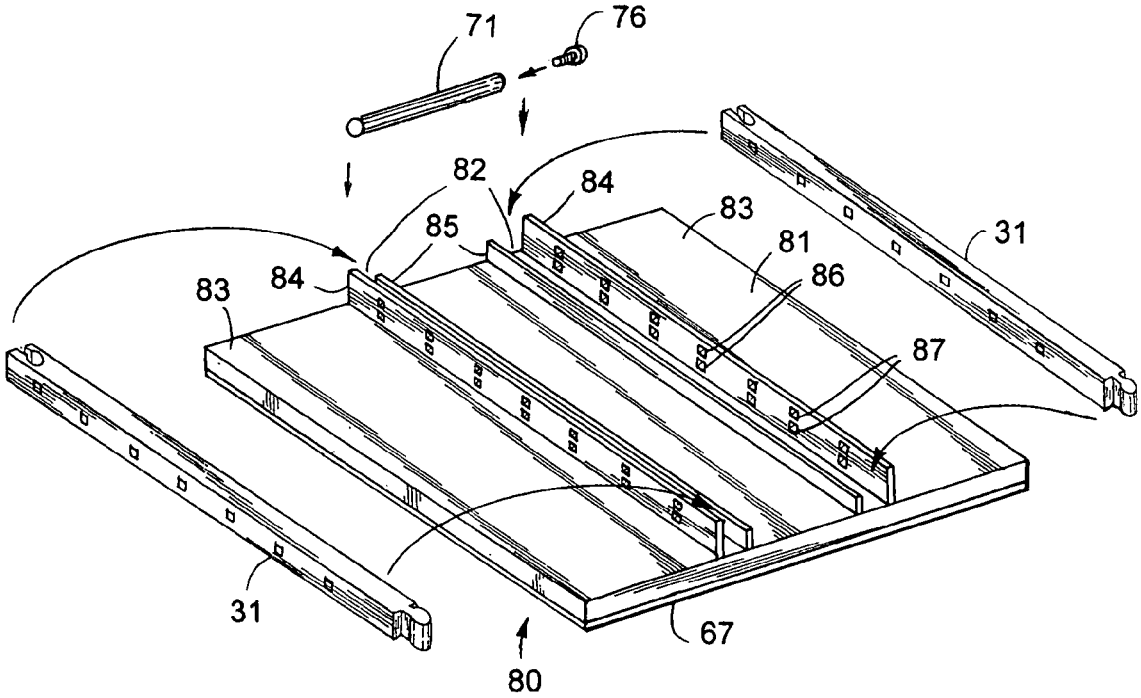
FIG. 6B shows how an anti-tip device is used in the assembly of a straight track.

A straight track may also be assembled with the aid of an anti-tip device 80. Refer to FIG. 6B. The anti-tip device is positioned on a flat surface. Each rectangular rail 31 of a straight track is positioned upon the anti-tip device, within each work holder area 82, and directly opposite one another. Each work holder area is bordered by an exterior 84 and interior 85 work stop abutment. The exterior work stop abutments 84 are each comprised of two rows of step insertion elements 86 into which steps 70 are inserted. The drawing depicts exterior work stop abutments 84 comprised of square shaped rung insertion elements 87. The drawing also depicts a readily detachable rung 71 with a squared rung closure 75 which is inserted through the square shaped rung insertion element 87 comprising one of the exterior work stop abutments 84, through the square shaped rung insertion elements 64 comprising each rail, and finally through the square shaped rung insertion element 87 comprising the other exterior work stop abutment. Assembly of the track is complete when the rungs are fastened joining the opposing rails together in a fixed parallel relationship.

3. Connecting a Track to Another Track or Distinct End Coupler

The ends of each track, straight 30, arced 40, or curved 50, are either comprised of two interfitting male connections 61 in a shape of a tenon or two interfitting female connections 62 corresponding to a recessed tenon. The assembled tracks are positioned on a flat surface. The act of connecting contiguous tracks is accomplished by lifting a track, straight, arced, or curved, and positioning the tenons 61 of the lifted track into corresponding tenon shaped recesses 62 of a contiguous track.

A track may also be connected to a contiguous distinct end coupler 90. Each side of a distinct end coupler comprises two matching elements used to effect connections to a contiguous track. The two matching elements are two interfitting male connections in a shape of a tenon 91 or two interfitting female connections in a shape corresponding to a recessed tenon 92. The assembled track and distinct end coupler are positioned on a flat surface. The act of connecting the track and the distinct end coupler is accomplished by lifting the track and positioning the tenons 61 of the lifted track into corresponding tenon shaped recesses 92 of the distinct end coupler or placing the tenon shaped recesses 62 of the lifted track around the tenons 91 of the distinct end coupler.

Each apparatus arranged in the designs shown in FIGS. 8,9, 10, 11, and 12 is assembled by connecting contiguous tracks and one or more distinct end coupler as described above.

DESCRIPTION—SECOND EMBODIMENT—FIGS. 13, 14, 15, 16A, 16B, and 16C

The second embodiment of the invention comprises straight 30, arced 40, and curved 50 tracks, each track comprising two rails joined together by affixed steps with geometrically shaped colored footings 170 and comprising a means 60 to connect to other tracks. Said second embodiment is described below and claimed in independent claim 9.

Figure 13:
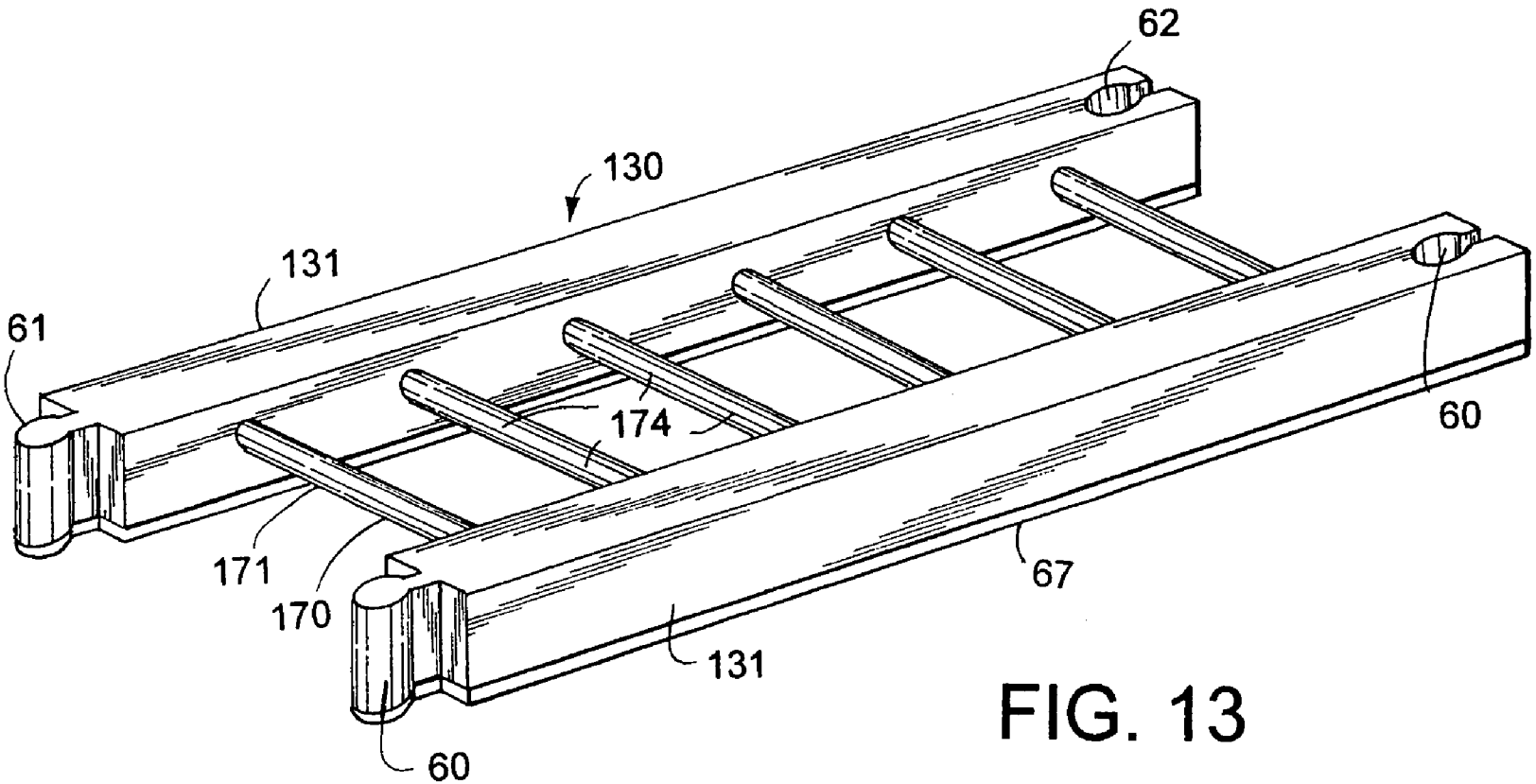
FIG. 13 shows a perspective view of a straight track with affixed rungs.

FIG. 13 shows a perspective view of a straight track 130. Said straight track comprises two rigid, rectangular rails each rail 131 of substantially equal dimensions joined together by affixed, colored steps 170. The drawing depicts affixed, colored rungs 171 comprising geometrically shaped footings 174. Each rung 171 is of substantially equal length and affixed perpendicularly at the interior side of each rectangular rail 131 serving to hold the rails in a parallel relationship to each other.

The straight track comprises elements 60 used to effect connections to a contiguous track or tracks, straight 130, arced 140, or curved 150, or to a distinct end coupler 90, thereby bridging the non-contiguous ends of tracks. The drawing depicts two interfitting male connections 61 in the shape of a tenon located at one end of the straight track and two interfitting female connections 62 in a shape corresponding to a recessed tenon located at the opposite end of the track.

The surface of the top side of the elongated rail 131 may be smooth or semi-rough. An anti-slide element 67 is affixed to the bottom side of the elongated rail.

The straight track is free of end boards as an element thereof removing an obstruction associated with prior art 23. The obstruction hinders entering or dismounting a track or traversing two connected tracks.

Figure 14:
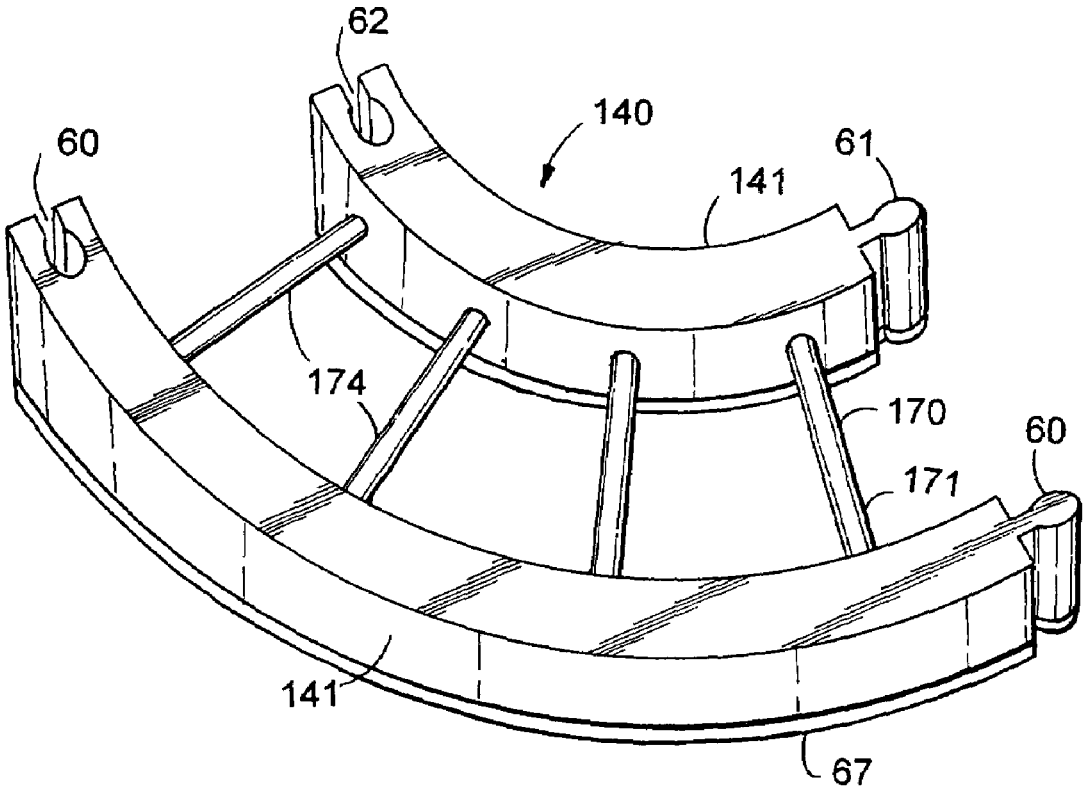
FIG. 14 shows a perspective view an arced track with affixed rungs.

FIG. 14 shows a perspective view of an arced track 140. Said arced track comprises two oblong, rigid, arced rails each rail 141 of substantially equal height and width joined together by affixed, colored steps 170. The drawing depicts affixed, colored rungs 171 comprising geometrically shaped footings 174. Each rung 171 is of substantially equal length and diametrically affixed length-wise at the interior side of each arced rail serving to hold the directly opposing rails in an equidistant relationship to each other.

The arced track comprises elements 60 used to effect connections to a contiguous track or tracks, straight 130, arced 140, or curved 150, or to a distinct end coupler 90, thereby bridging the ends of tracks. The drawing depicts two interfitting male connections 61 in the shape of a tenon located at one end of the arced track and two interfitting female connections 62 in a shape corresponding to a recessed tenon located at the opposite end of the track.

The surface of the top side of the arced rail 141 may be smooth or semi-rough. An anti-slide element 67 is affixed to the bottom side of the arced rail.

The arced track is free of end boards as an element thereof removing an obstruction associated with prior art 23. The obstruction hinders entering or dismounting a track or traversing two connected tracks.

Figure 15:
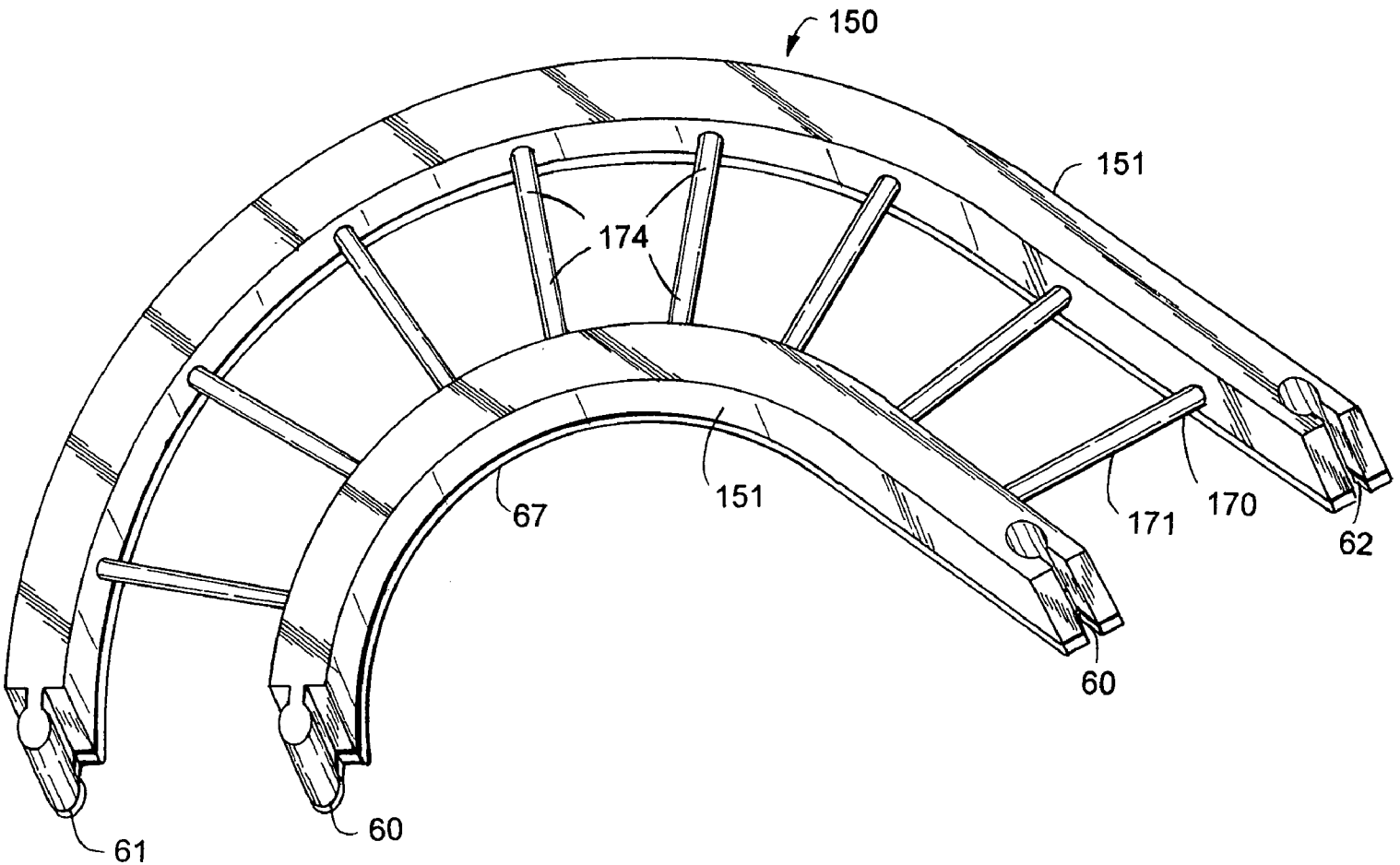
FIG. 15 shows a perspective view of a curved track with affixed rungs.

FIG. 15 shows a perspective view of a curved track 150. Said curved track comprises two curved, oblong, rigid rails each rail 151 of substantially equal height and width joined together by affixed, colored steps 170. The drawing depicts affixed, colored rungs 171 comprising geometrically shaped footings 174. Each rung 171 is of substantially equal length and diametrically or otherwise affixed length-wise at the interior side of each curved rail serving to hold the directly opposing rails in an equidistant relationship to each other.

The curved track comprises elements 60 used to effect connections to a contiguous track or tracks, straight 130, arced 140, or curved 150, or to a distinct end coupler 90, thereby bridging the ends of tracks. The drawing depicts two interfitting male connections 61 in the shape of a tenon located at one end of the arced track and two interfitting female connections 62 in a shape corresponding to a recessed tenon located at the opposite end of the track.

The surface of the top side of the curved rail 151 may be smooth or semi-rough. An anti-slide element 67 is affixed to the bottom side of the curved rail.

The curved track is free of end boards as an element thereof removing an obstruction associated with prior art 23. The obstruction hinders entering or dismounting a track or traversing two connected tracks.

Figure 16A:
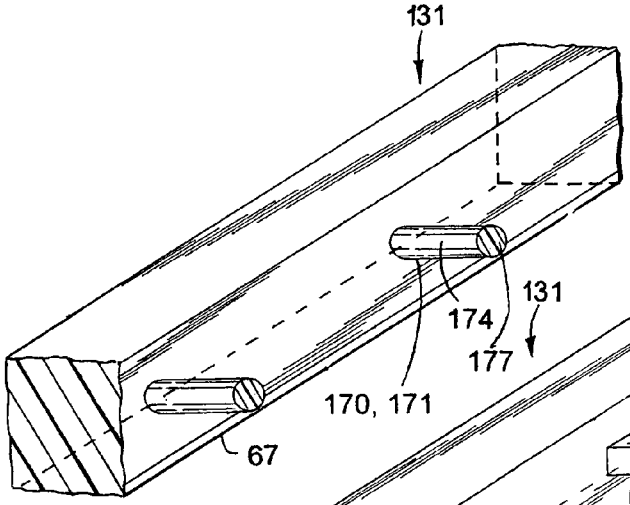
FIG. 16A shows a perspective view of an affixed rung with an oval shaped colored footing.
Figure 16B:
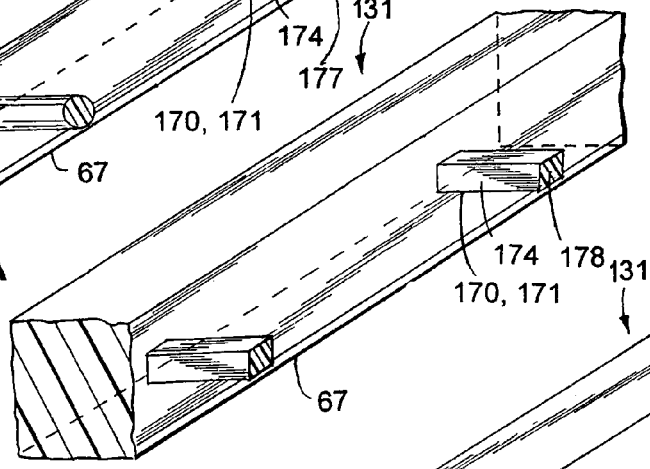
FIG. 16B shows a perspective view of an affixed rung with a rectangular shaped colored footing.
Figure 16C:
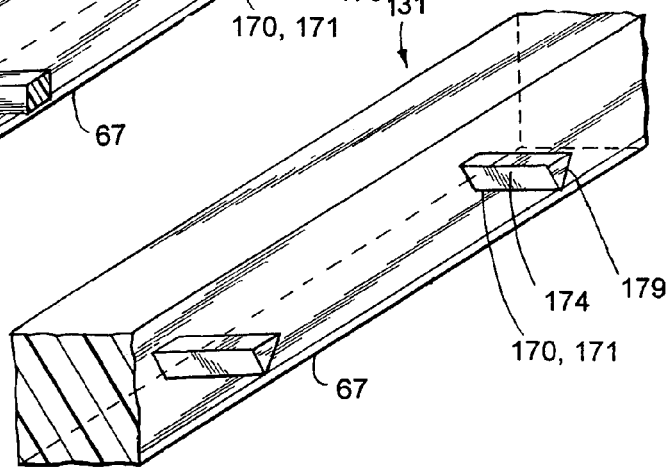
FIG. 16C shows a perspective view of an affixed rung with a triangular shaped colored footing.

FIGS. 16A, 16B, and 16C show perspective cross-section views of affixed rungs 171, a type of step 170, with oval 177, rectangular 178, and triangular 179 shaped colored footings, respectively. A rectangular rail 131 is used as a backdrop although an arced or curved rail may have been depicted. Each rung is affixed length-wise at the interior side of each rail serving to hold the directly opposing rails in a fixed relationship to one another.

The second embodiment of the invention further includes additional features described below. Each additional feature is represented in a dependent claim identified in Claims 10 through 15 and is depicted in FIGS. 6A, 7A, 7B, 7C, 8, 9, 10, 11, or 12.

The second embodiment of the invention further includes an anti-tip device 80 for use with a straight track 130. FIG. 6A shows a perspective view of said anti-tip device. The anti-tip device comprises an elongated, rectangular shaped planar surface 81 and two work holder areas 82. Each work holder area is in the shape of a rectangular rail 31 and bordered by two raised elongated work stop abutments, a tall exterior work stop abutment 84 and a shorter interior work stop abutment 85. The drawing depicts rectangular shaped rung insertion elements 87, which are not used in this embodiment of the invention. The anti-tip element 83 is comprised of the portions of the planar surface 81 extending out from each exterior work stop abutment 84. An anti-slide element 67 is affixed to the bottom side of the anti-tip device.

The second embodiment of the invention further includes a geometrically shaped distinct end coupler 90. FIG. 7A shows a perspective view of a diamond shaped distinct end coupler 95. FIG. 7B shows a perspective view of an octagon shaped distinct end coupler 96. FIG. 7C shows a perspective view of a rectangular shaped distinct end coupler 97. Each distinct end coupler 90 comprises a planar surface 91 comprising elongated stripes 94 connecting the non-contiguous ends of two tracks in a visual sense. Each side of a distinct end coupler comprises either two interfitting male connections 92 in the shape of a tenon or two interfitting female connections 93 in a shape corresponding to a recessed tenon. These elements are used to effect connections with one or more contiguous tracks, straight 130, arced 140, or curved 150, thereby bridging non-contiguous tracks. An anti-slide element 67 is affixed to the bottom side of each distinct end coupler.

The second embodiment of the invention further includes various design apparatuses each apparatus traversed horizontally by a human. Said apparatuses are shown in FIGS. 8, 9, 10, 11, and 12. Each apparatus comprises a straight track 130 or tracks, an arced track 140 or tracks, or a curved track 150 or tracks, or a combination thereof Each track is connected to one or more contiguous tracks or to a distinct end coupler 90, thereby bridging non-contiguous ends of tracks.

FIG. 8 shows a topside view of the second embodiment of the invention in the design of a figure eight lying on its side. The apparatus is comprised of tracks contiguously connected and a diamond shaped distinct end coupler 95 used as a bridge to connect the non-contiguous ends of tracks. The distinct end coupler is located at the center of the apparatus.

FIG. 9 shows a topside view of the second embodiment of the invention in the design of a figure eight lying on its side. The apparatus is comprised of tracks contiguously connected and an octagon shaped distinct end coupler 96 used as a bridge to connect the non-contiguous ends of tracks. The distinct end coupler is located at the center of the apparatus.

FIG. 10 shows a topside view of the preferred embodiment of the invention in the design of a figure eight lying on its side longitudinally intersected at its center by a column of straight tracks. The apparatus is comprised of tracks contiguously connected and an octagon shaped end coupler 96 used as a bridge to connect the non-contiguous ends of tracks, including the column of straight tracks 30. The distinct end coupler is located at the center of the apparatus.

FIG. 11 shows a topside view of the preferred embodiment of the invention in the design of a figure eight lying on its side longitudinally and laterally intersected at its center by a column and row of straight tracks. The apparatus is comprised of tracks contiguously connected and an octagon shaped distinct end coupler 96 used as a bridge to connect the non-contiguous ends of tracks, including the column and row of straight tracks 30. The distinct end coupler is located at the center of the apparatus.

FIG. 12 shows a topside view of the second embodiment of the invention in the design of a circle enclosing a plus sign. Each arced track 140 comprising the circle is connected to one or more contiguous arced tracks or connected to one or more tracks, straight or arced, with the aid of a rectangular shaped distinct end coupler 97. Each straight track 130 comprising the plus sign is connected to one or more contiguous straight tracks or connected to one or more tracks, straight or arced, with the aid of a contiguous rectangular shaped distinct end coupler 97. A distinct end coupler 97 is located at the center of the plus sign bridging the non-contiguous ends of four straight tracks. Four distinct end couplers 97 are located at the ends of the plus sign each distinct end coupler intersecting and connecting with the circle of arced tracks bridging the non-contiguous ends of straight and arced tracks.

Operation—Second Embodiment

1. Traversing a Track, Tracks, or an Apparatus

The second embodiment of the invention is an article of educational equipment horizontally traversed by a human. The invention comprises tracks, straight 130, arced 140, or curved 150. A single track may be traversed. A track may be connected to a contiguous track or tracks, straight, arced, or curved, and the combination of tracks traversed. A track may be connected to a contiguous distinct end coupler 90 bridging one end of the track to the end of a non-contiguous track or tracks, straight, arced, or curved. The combination of tracks and the distinct end coupler are then traversed. Contiguous tracks and tracks with the aid of one or more distinct end couplers may be joined together to create an apparatus in a design shown in FIGS. 8, 9, 10, 11, or 12. The apparatus is then traversed.

A human may traverse geometrically shaped colored footings of the steps 170 of a track or walk upon the top side of either rail using the rail as a balance beam The height of each step 170 is substantially the same. An anti-slide element 67 is affixed to the bottom sides of each rail distinct end coupler 90, and anti-tip device 80 preventing a track from shifting while being traversed.

In addition to bridging the non-contiguous ends of tracks, a distinct end coupler 90 is an agent used to traverse from one track to another. The planar surface 91 comprises elongated stripes 94 visually connecting non-contiguous ends of tracks thereby assisting a walking human. A distinct end coupler is also used as a station on which a human stands while receiving instructions prior to traversing a track or apparatus.

An anti-tip device 80 may be employed to prevent tipping of a straight track 30 while under foot. An anti-tip device provides protection in two ways. First, an anti-tip element 83 is comprised of the portions of the elongated, rectangular planar surface 81 that extend out from each exterior work stop abutment 84. Second, the sides of each rectangular rail 31 lie adjacent to the exterior 84 and interior 85 work stop abutments gaining support.

2. Connecting a Track to Another Track or Distinct End Coupler

The ends of each track, straight 130, arced 140, or curved 150, are either comprised of two interfitting male connections 61 in a shape of a tenon or two interfitting female connections 62 corresponding to a recessed tenon. The tracks are positioned on a flat surface. The act of connecting contiguous tracks is accomplished by lifting a track, straight, arced, or curved, and positioning the tenons 61 of the lifted track into corresponding tenon shaped recesses 62 of a contiguous track.

A track may also be connected to a contiguous distinct end coupler 90. Each side of a distinct end coupler comprises two matching elements used to effect connections to a contiguous track. The two matching elements are two interfitting male connections in a shape of a tenon 91 or two interfitting female connections in a shape corresponding to a recessed tenon 92. The track and distinct end coupler are positioned on a flat surface. The act of connecting the track and the distinct end coupler is accomplished by lifting the track and positioning the tenons 61 of the lifted track into corresponding tenon shaped recesses 92 of the distinct end coupler or placing the tenon shaped recesses 62 of the lifted track around the tenons 91 of the distinct end coupler.

Each apparatus arranged in the designs shown in FIGS. 8, 9, 10, 11, and 12 is assembled by connecting contiguous tracks and one or more distinct end coupler as described above.

DESCRIPTION—THIRD EMBODIMENT—FIGS. 17, 18, 19, 16A, 16B, and 16C The third embodiment of the present invention comprises straight 230, arced 240, and curved 250 tracks, each track comprising two rails joined together by affixed steps with geometrically shaped colored footings 170. Said third embodiment is described immediately below and claimed in independent Claim 16.

Figure 17:
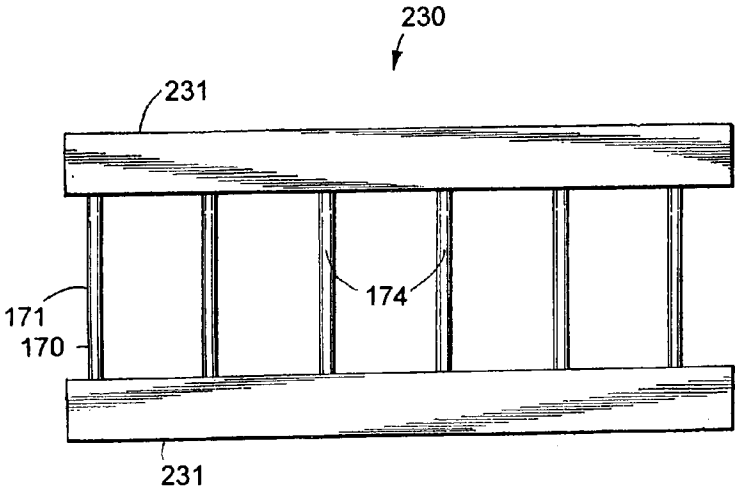
FIG. 17 shows a topside view of a straight track with affixed rungs and without track connecting elements.

FIG. 17 shows a topside view of a straight track 230. Said straight track comprises two rigid, rectangular rails each rail 231 of substantially equal dimensions joined together by affixed, colored steps 170. The drawing depicts affixed, colored rungs 171 comprising geometrically shaped footings 174. Each rung 171 is of substantially equal length and perpendicularly affixed at the interior side of each rectangular rail serving to hold the rails in a parallel relationship to each other. The surface of the top side of the rectangular rail 231 may be smooth or semi-rough.

The straight track is free of end boards as an element thereof removing an obstruction associated with prior art 23. The obstruction hinders entering or dismounting a track or traversing two connected tracks.

Figure 18:
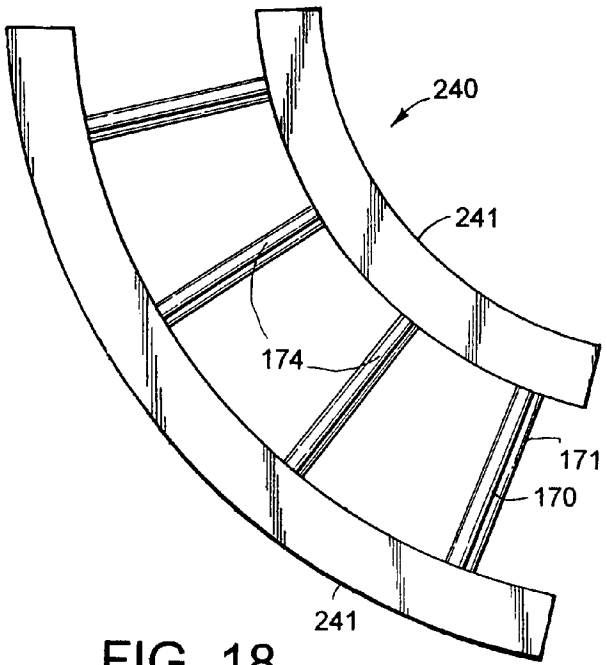
FIG. 18 shows a topside view of an arced track with affixed rungs and without track connecting elements.

FIG. 18 shows a topside view of an arced track 240. Said arced track comprises two oblong, rigid, arced rails each rail 241 of substantially equal height and width joined together by affixed, colored steps 170. The drawing depicts affixed, colored rungs 171 comprising geometrically shaped footings 174. Each rung 171 is of substantially equal length and diametrically affixed length-wise at the interior side of each arced rail serving to hold the directly opposing rails in an equidistant relationship to each other. The surface of the top side of the arced rail 241 may be smooth or semi-rough.

The arced track is free of end boards as an element thereof removing an obstruction associated with prior art 23. The obstruction hinders entering or dismounting a track or traversing two connected tracks.

Figure 19:
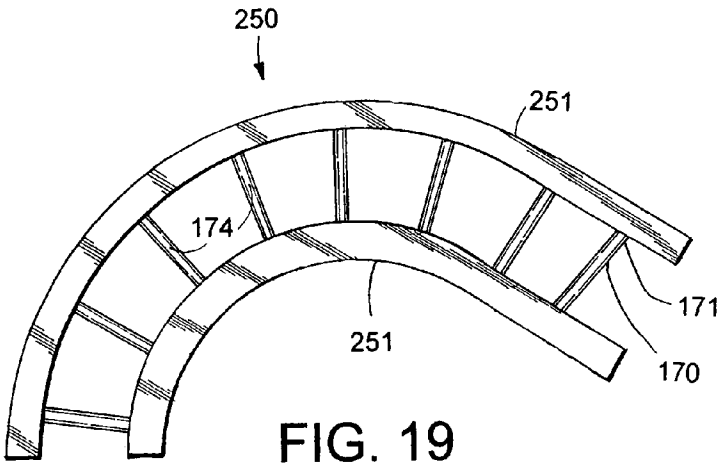
FIG. 19 shows a topside view of a curved track with affixed rungs and without track connecting elements.

FIG. 19 shows a topside view of a curved track 250. Said curved track comprises two curved, oblong, rigid rails each rail 251 of substantially equal height and width joined together by affixed, colored steps 170. The drawing depicts affixed, colored rungs 171 comprising geometrically shaped footings 174. Each rung 171 is of substantially equal length and diametrically or otherwise affixed length-wise at the interior side of each curved rail serving to hold the directly opposing rails in an equidistant relationship to each other. The surface of the top side of the curved rail 251 may be smooth or semi-rough.

The curved track is free of end boards as an element thereof removing an obstruction associated with prior art 23. The obstruction hinders entering or dismounting a track or traversing two connected tracks.

FIGS. 16A, 16B, and 16C show perspective cross-section views of affixed rungs 171, a type of step 170, with oval 177, rectangular 178, and triangular 179 shaped colored footings, respectively. A rectangular rail 231 is used as a backdrop although an arced or curved rail may have been depicted. Each rung is affixed length-wise at the interior side of each rail serving to hold the directly opposing rails in a fixed relationship to one another.

The third embodiment of the invention further includes additional features described below. Each additional feature is represented in a dependent claim identified in Claims 17 through 20 and is depicted in FIGS. 20, 21, 22, and 23.

Figure 20:
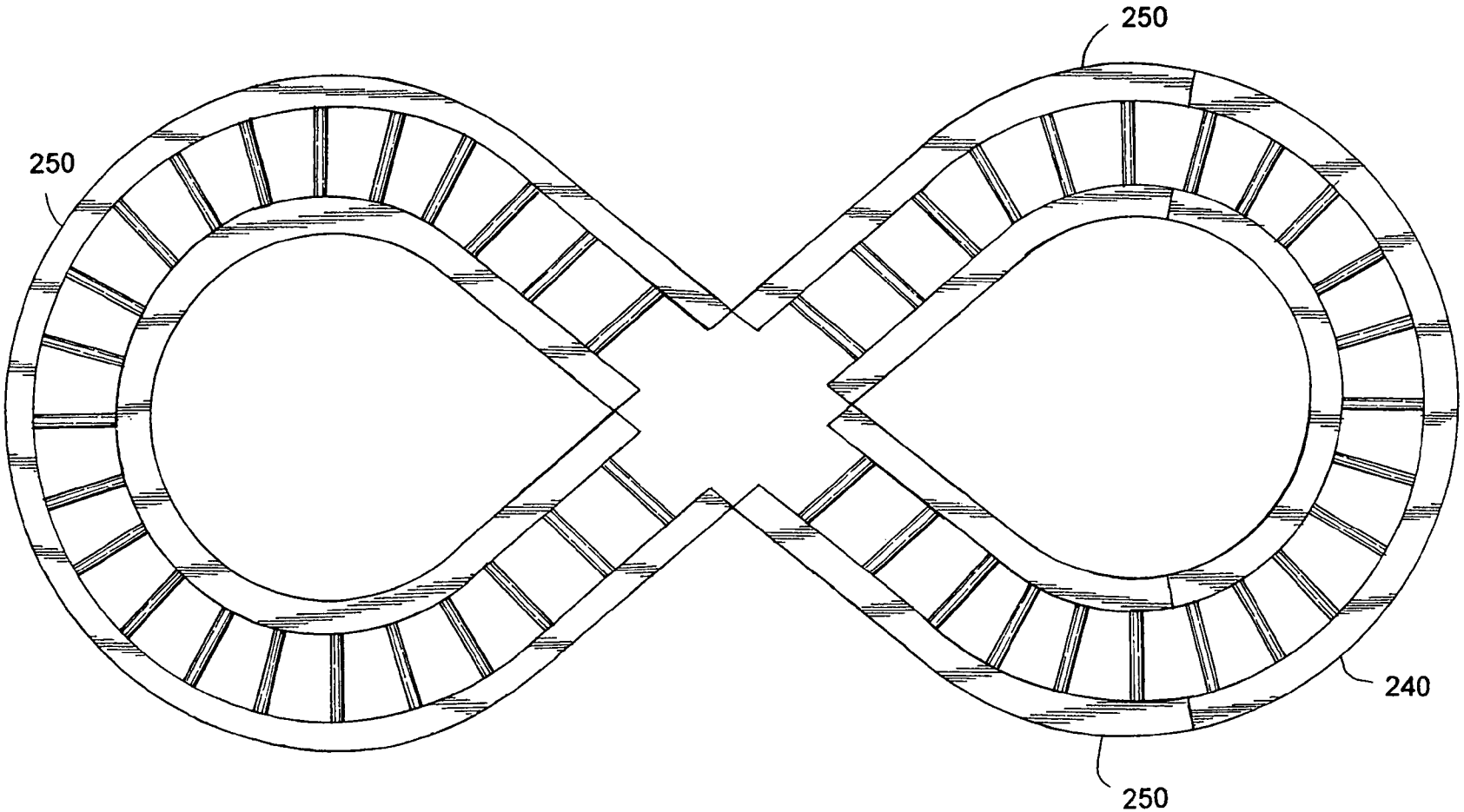
FIG. 20 shows a topside view of tracks comprising the design of a figure eight lying on its side.

The third embodiment of the invention further includes various design apparatuses each apparatus traversed horizontally by a walking human. Said apparatuses are shown in FIGS. 20, 21, 22, and 23. Each apparatus comprises a straight track or tracks 230, an arced track or tracks 240, or a curved track or tracks 250, or a combination thereof FIG. 20 shows a topside view of the third embodiment of the invention in the design of a figure eight lying on its side. The apparatus is comprised of one or more straight, arced, or curved tracks.

FIG. 21 shows a topside view of the third embodiment of the invention in the design of two non-contiguous sets of connected arced and curved tracks each in the shape of a horseshoe located on the left and right sides of the design the open ends of each horseshoe shaped set of tracks directly opposite and laterally positioned to one another and two non-continuous straight tracks centrally located on the upper and lower sides of the design directly opposite and longitudinally positioned to one another, all of the horseshoe shaped sets of tracks and straight tracks border an octagon shaped open area in the middle of the design. The apparatus is comprised of one or more straight, arced, or curved tracks.

FIG 22 shows a topside view of the third embodiment of the invention in the design of two non-contiguous sets of connected arced and curved tracks each in the shape of a horseshoe located on the left and right sides of the design, within each of which a straight track is laterally and centrally positioned the ends of the each straight track abutting or lying at the interior sides of the horseshoe shaped set of tracks, the open ends of each horseshoe shaped set of tracks directly opposite and laterally positioned to one another and two non-continuous straight tracks centrally located on the upper and lower sides of the design directly opposite and longitudinally positioned to one another, all of the horseshoe shaped sets of tracks, inclusive of the partially enclosed laterally positioned straight tracks, and the longitudinally positioned straight tracks border an octagon shaped open area in the middle of the design. The apparatus is comprised of one or more straight, arced, or curved tracks.

FIG. 23 shows a topside view of the third embodiment of the invention in the design of a circle enclosing a plus sign. The circle is comprised of one or more arced tracks 240. The plus sign is comprised of two or more straight tracks 230. The arced and straight tracks may be connected to one another.

Operation—Third Embodiment

Traversing a Track, Tracks, or an Apparatus

The third embodiment of the invention is an article of educational equipment horizontally traversed by a walking human. The invention comprises tracks, straight 230, arced 240, or curved 250. A single track may be traversed. A track may be joined to one or more tracks, straight, arced, or curved, and the combination of tracks traversed. Tracks may be joined together to create an apparatus in a design shown in FIGS. 20, 21, 22, or 23. The apparatus is then traversed.

A human may traverse the colored, geometrically shaped step 170 of a track or walk upon the top side of either rail using the rail as a balance beam. The height of each step 170 is substantially the same.

Advantages of the Embodiments of the Invention

From the descriptions above, a number of advantages of the embodiments of the invention over prior art become apparent:

Each embodiment comprises straight, arced, and curved tracks.

Each track of the preferred embodiment comprises two rails that are joined together by readily detachable steps. One or more steps may be removed without the necessity of dismantling the track. The steps may be adjusted to accommodate the stride of a walking human. If the rails of a track comprise step insertion elements that are not level, the height of the rungs may be varied increasing the traversing challenge.

Each embodiment comprises steps with colored footings that are oval, rectangular, or triangular shaped.

Each track of the preferred and second embodiments comprise track connecting elements used to effect connections with one or more contiguous tracks or a contiguous distinct end coupler.

Each embodiment comprises tracks that are free of end boards removing an obstruction associated with prior art. The obstruction would otherwise hinder entering or dismounting a track or traversing two connected tracks. As regards the preferred embodiment, the removal of the end boards also increases versatility as the rails of a straight track may be widened or narrowed to accommodate teaching methods and traversing alternatives, such as by wheelchair.

The preferred and seconds embodiments further include an anti-tip device used with a straight track that prevents tipping of the track while being traversed. In the preferred embodiment, the anti-tip device is also used as an aid in the assembly of a straight track.

The preferred and second embodiments further include a geometrically distinct end coupler, an intermediate structure that bridges the non-contiguous ends of two or more tracks, straight, arced, or curved. In addition to bridging the ends of tracks, a distinct end coupler is used as an agent to traverse from one track to another as a station on which a human stands while receiving instructions prior to traversing a track or tracks.

The preferred and second embodiments further include a number of apparatuses using the design of a figure eight lying on its side. The apparatuses are comprised of tracks, straight, arced, or curved, contiguously connected and a distinct end coupler used as a bridge to connect the non-contiguous ends of tracks. The apparatuses described in the third embodiment comprise tracks but not a distinct end coupler. A human traverses the steps or rung footings or a rail, using the rail as a balance beam, performing specific routines that are intended to increase learning capabilities. The functions of these design apparatuses are in addition to those functions that are accomplished with tracks, straight, arced, or curved, not used in combination. For example, a human traverses the apparatuses forming the letters of the alphabet, and, as a result, the brain is imprinted with the letters of the alphabet.

The preferred and second embodiments further include an apparatus in the design of a circle enclosing a plus sign. The apparatus is comprised of tracks, arced and straight, contiguously connected and a distinct end coupler used as a bridge to connect the non-contiguous ends of tracks. The apparatus described in the third embodiment comprise tracks but not a distinct end coupler. A walking human traverses the steps or rung footings or a rail, using the rail as a balance beam, performing specific routines that are intended to increase learning capabilities. The functions of the design apparatus are in addition to those functions that are accomplished with tracks, straight, arced, or curved, not in combination. For example, a walking human traverses the circle as if it was a timepiece or map.

CONCLUSION, RAMIFICATIONS, AND SCOPE

Accordingly, the invention is a significant improvement over prior art promoting, fostering, and facilitating the learning process. The invention comprises tracks, straight, arced, and curved, and design apparatuses comprising tracks. The tracks comprise unique elements. Each rail comprises elements used to effect connections to other tracks and elements into or through which readily detachable rungs are inserted. The invention also comprises distinct end couplers used to connect non-contiguous tracks and an anti-tip device used with a straight track to avoid tipping.

Based upon brain research findings that supports the link of movement to learning, the result achieved by a human traversing a track or an apparatus, comprising the tracks, is increased sensory motor development, longer focus and attention, coordination of motor skills, better balance in the vestibular system, awareness of basic rhythmic patterns, and improved learning readiness. The basic design of the tracks, including the shapes and colors of the rungs, and the designs of the apparatuses provide the framework for the development of academic concepts including, but not limited to, color, shape, and number recognition, basic math operations, early literacy, reading readiness, handwriting skills, map skills, time concepts, and other basic early childhood curriculum. Because the tracks are traversed while practicing academic concepts, the learning is anchored in the brain for better memory retention and retrieval as a human has combined physical and cognitive domains.

If humans jointly participate in a track activity including the assembly of a track, building an apparatus of tracks, traversing a track or an apparatus, or disassembly of a track or an apparatus, team concepts, peer help, and cooperation skills are developed resulting in better social behavior and life skills.

The material used to manufacture a rail, a distinct end coupler, and an anti-tip device must be sturdy, durable, color-safe, and weather resistant. An assembled track should be light in weight making the track easy to assemble and dismantle, connect to other tracks or couplers, transport, and store. However, a track must be of a sufficient weight to avoid shifting while under foot. The material used to manufacture a rung must also be sturdy, durable, color-safe, and weather resistant. A step or rung must be capable of withstanding a considerable weight. If the tracks are used outdoors, the material used to manufacture the rails, steps, and rungs must be heavier and rust resistant.

Although the description above contains much specificity, it should not be construed as limiting the scope of the invention but merely providing illustrations of some of the embodiments of this invention. For example, the shapes of rails and the shape and location of the elements comprising rails including the step insertion and track connecting elements, the shapes of steps, the shapes of distinct end couplers and the elements comprising a coupler, and the designs of the apparatuses are not limited to the shapes, locations, and designs shown in the drawings. The methods used to install readily detachable steps or connect tracks are not limited to those shown or described.

Thus the scope of the invention should be determined by the appended claims and their legal equivalents, rather than by the examples given.

We claim:

1. An article of educational equipment horizontally traversed by a human comprising:

a) a straight track comprising:

i) two elongated, rigid, rectangular rails each rail of substantially equal dimensions comprising elements used to effect a connection with a contiguous rail of another track, straight, arced, or curved, or used to effect a connection with a contiguous distinct end coupler comprising elements used to effect connections with contiguous rails of two or more tracks, straight, arced, or curved, thereby bridging the non-contiguous ends of the tracks, ii) each rail comprising elements located in whole or part at its interior side used to effect connections with steps, and iii) multiple steps each readily detachable with a geometrically shaped colored footing, of substantially equal length, perpendicularly placed length-wise in an element located in whole or part at the interior side of each rectangular rail, and while connected to each rail incapable of rotating or shifting horizontally, serving to hold the directly opposing rails in a fixed parallel relationship to each other, and of substantially the same height;

b) an arced track comprising:

i) two oblong, rigid, arced rails each rail of substantially equal height and width comprising elements used to effect a connection with a contiguous rail of another track, straight, arced, or curved, or used to effect a connection with a contiguous distinct end coupler comprising elements used to effect connections with contiguous rails of two or more tracks, straight, arced, or curved, thereby bridging the non-contiguous ends of the tracks, ii) each rail comprising elements located in whole or part at its interior side used to effect connections with steps, and iii) multiple steps each readily detachable with a geometrically shaped colored footing, of substantially equal length, perpendicularly placed length-wise in an element located in whole or part at the interior side of each rectangular rail, and while connected to each rail incapable of rotating or shifting horizontally, serving to hold the directly opposing rails in a fixed equidistant relationship to each other, and of substantially the same height;

c) a curved track comprising:

i) two oblong, rigid, curved rails each rail of substantially equal height and width comprising elements used to effect a connection with a contiguous rail of another track, straight, arced, or curved, or used to effect a connection with a contiguous distinct end coupler comprising elements used to effect connections with contiguous rails of two or more tracks, straight, arced, or curved, thereby bridging the non-contiguous ends of the tracks, ii) each rail comprising elements located in whole or part at its interior side used to effect connections with steps, and iii) multiple steps each readily detachable with a geometrically shaped colored footing, of substantially equal length, perpendicularly placed length-wise in an element located in whole or part at the interior side of each rectangular rail, and while connected to each rail incapable of rotating or shifting horizontally, serving to hold the directly opposing rails in a fixed equidistant relationship to each other, and of substantially the same height;

whereby said straight, arced, and curved tracks exclude obstructions thereby allowing contiguous connection between two or more straight, arced, or curved tracks.

2. The article of educational equipment of claim 1 wherein said tracks, straight, arced, or curved, comprising rails, rectangular, arced, or curved, which comprise elements located in whole or part at the interior side of each rail used to effect a connection with a step said elements in a pattern permitting the height of the steps to be varied.

3. The article of educational equipment claim 1 further including an anti-tip device on which a straight track is assembled and positioned, said anti-tip device comprising a) an elongated, rectangular planar surface lying between and under the rectangular rails of a straight track and extending out from the exterior sides of each rail, and b) two elongated work holder areas each work holder area bordered by two elongated work stop abutments into which a rectangular rail is inserted the abutment adjacent to the exterior side of a rail is higher than the interior side abutment and the exterior side abutment comprises rectangular shaped elements into or through which steps are inserted during the process of assembling a straight track.

4. The article of educational equipment of claim 1 further including a distinct end coupler, in the shape of a polygon, including a rectangle, diamond, hexagon, or octagon, comprising elements used to effect connections with contiguous rails of two or more tracks, straight, arced, or curved, thereby bridging the non-contiguous ends of the tracks.

5. The article of educational equipment of claim 1 further including an apparatus in the shape of a figure eight lying on its side comprising a straight track or tracks, an arced track or tracks, or a curved track or tracks, or a combination of two or more tracks, whereby the tracks are either contiguously connected to one another or connected to one another with the aid of a centrally located distinct end coupler, in the shape of a polygon, including a diamond or octagon, thereby bridging the non-contiguous ends of the tracks.

6. The article of educational equipment of claim 5 further including a column of straight tracks longitudinally intersecting said apparatus at its center whereby the tracks are either connected to one another or connected to one another with the aid of said distinct end coupler, thereby bridging the non-contiguous ends of the tracks.

7. The article of educational equipment of claim 6 further including a row of straight tracks laterally intersecting said apparatus at its center whereby the tracks are either contiguously connected to one another or connected to one another with the aid of the distinct end coupler, thereby bridging the non-contiguous ends of the tracks.

8. The article of educational equipment claim 1 further including an apparatus in the shape of a circle enclosing a plus sign comprising one or more arced tracks in the shape of a circle and one or more straight tracks in the shape of a plus sign whereby the tracks, arced or straight, are contiguously connected to one another or connected to another track, arced or straight, with the aid of one or more distinct end couplers, each in the shape of a polygon, including a rectangle, located at the center of the plus sign and located at the ends of the plus sign intersecting and connecting with the circle, thereby bridging non-contiguous ends of the tracks.

9. An article of educational equipment horizontally traversed by a walking human comprising:

a) a straight track comprising:

i) two elongated, rigid, rectangular rails each rail of substantially equal dimensions, comprising elements used to effect a connection with a contiguous rail of another track, straight, arced, or curved, or used to effect a connection with a contiguous distinct end coupler comprising elements used to effect connections with contiguous rails of two or more tracks, straight, arced, or curved, thereby bridging the non-contiguous ends of the tracks, ii) multiple rungs each rung with a colored, geometrically shaped footing, of substantially equal length, perpendicularly affixed at the interior side of each rectangular rail serving to hold the rails in a fixed parallel relationship to each other;

b) an arced track comprising:

i) two arced oblong, rigid, arced rails each rail of substantially equal height and width comprising elements used to effect a connection with a contiguous rail of another track, straight, arced, or curved, or used to effect a connection with a contiguous distinct end coupler comprising elements used to effect connections with contiguous rails of two or more tracks, straight, arced, or curved, thereby bridging the non-contiguous ends of the tracks, and ii) multiple rungs each rung with a colored, geometrically shaped footing, of substantially equal length and diametrically affixed length-wise at the interior side of each arced rail serving to hold the directly opposing rails in a fixed equidistant relationship to each other;

c) a curved track comprising:

i) two curved oblong, rigid, curved rails each rail of substantially equal height and width, comprising elements used to effect a connection with a contiguous rail of another track, straight, arced, or curved, or used to effect a connection with a contiguous distinct end coupler comprising elements used to effect connections with contiguous rails of two or more tracks, straight, arced, or curved, thereby bridging the non-contiguous ends of the tracks, and ii) multiple rungs each rung with a colored, geometrically shaped footing, of substantially equal length and diametrically or otherwise affixed length-wise at the interior side of each curved rail serving to hold the directly opposing rails in a fixed equidistant relationship to each other;

whereby said straight, arced, and curved tracks exclude obstructions thereby allowing contiguous connection between two or more straight, arced, or curved tracks.

10. The article of educational equipment of claim 9 further including an anti-tip device on which a straight track is positioned serving to protect the track against tipping, said anti-tip device comprising a) an elongated, rectangular planar surface lying between and under the rectangular rails and extending out from the exterior sides of each rail, and b) two work holder areas each work holder area bordered by two elongated work stop abutments the abutment adjacent to the exterior side of a rail is higher than the interior side abutment into which each affixed rail of a straight track is positioned.

11. The article of educational equipment of claim 9 further including a distinct end coupler, in the shape of a polygon, including a rectangle, diamond, hexagon, or octagon, comprising elements used to effect connections with contiguous rails of two or more tracks, straight, arced, or curved, thereby bridging the non-contiguous ends of the tracks.

12. The article of educational equipment of claim 9 further including an apparatus in the shape of a figure eight lying on its side comprising a straight track or tracks, an arced track or tracks, or a curved track or tracks, or a combination of two or more tracks, whereby the tracks are either contiguously connected to one another or connected to one another with the aid of a centrally located distinct end coupler, in the shape of a polygon, including a diamond or octagon, thereby bridging the non-contiguous ends of the tracks.

13. The article of educational equipment of claim 12 further including a column of straight tracks intersecting said apparatus at its center whereby the tracks are either contiguously connected to one another or connected to one another with the aid of said distinct end coupler, thereby bridging the non-contiguous ends of the tracks.

14. The article of educational equipment of claim 13 further including a row of straight rows laterally intersecting said apparatus at its center whereby the tracks are either contiguously connected to one another or connected to one another with the aid of the distinct end coupler, thereby bridging the non-contiguous ends of the tracks.

15. The article of educational equipment of claim 9 further including an apparatus in the shape of a circle enclosing a plus sign comprising one or more arced tracks in the shape of a circle and one or more straight tracks in the shape of a plus sign whereby the tracks, arced or straight, are either contiguously connected to one another or connected to another track, arced or straight, with the aid of one or more distinct end couplers, in the shape of a polygon, including a rectangle, located at the center of the plus sign and located at the ends of the plus sign intersecting and connecting with the circle, thereby bridging non-contiguous ends of the tracks.

16. An article of educational equipment horizontally traversed by a human comprising:

a) a straight track comprising:

i) two elongated, rigid, rectangular rails each rail of substantially equal dimensions, and ii) multiple rungs each rung with a colored, geometrically shaped footing, of substantially equal length, perpendicularly affixed at the interior side of each rectangular rail serving to hold the rails in a fixed parallel relationship to each other;

b) an arced track comprising:

i) two arced oblong, rigid, arced rails each rail of substantially equal height and width, and ii) multiple rungs each rung with a colored, geometrically shaped footing, of substantially equal length, and diametrically affixed length-wise at the interior side of each arced rail serving to hold the directly opposing rails in a fixed equidistant relationship to each other;

c) a curved track comprising:

i) two curved oblong, rigid, curved rails each rail of substantially equal height and width, and ii) multiple rungs each rung with a colored, geometrically shaped footing, of substantially equal length and diametrically or otherwise affixed length-wise at the interior side of each curved rail serving to hold the directly opposing rails in a fixed equidistant relationship to each other;

whereby said straight, arced, and curved tracks exclude obstructions thereby allowing contiguous connection between two or more straight, arced, or curved tracks.

17. The article of educational equipment of claim 16 further including an apparatus in the shape of a figure eight lying on its side comprising a straight track or tracks, an arced track or tracks, or a curved track or tracks, or a combination of two or more tracks, whereby the tracks may be joined to one another.

18. The article of educational equipment of claim 16 further including an apparatus comprising two non-contiguous sets of connected arced and curved tracks each set in the shape of a horseshoe located on the left and right sides of the design the open ends of each horseshoe shaped set of tracks located directly opposite and laterally positioned to one another and two non-contiguous straight tracks centrally located on the upper and lower sides of the design directly opposite and longitudinally positioned to one another, all of the horseshoe shaped sets of tracks and straight tracks border an octagon shaped open area in the middle of the design.

19. The article of educational equipment of claim 18 further including two straight tracks one laterally and centrally positioned within and abutting or lying at the interior sides of a set of horseshoe shaped tracks and the other similarly positioned within the opposing set of horseshoe shaped tracks, all of the horseshoe shaped sets of tracks, inclusive of said partially enclosed laterally positioned straight tracks, and longitudinally positioned straight tracks border an octagon shaped open area in the middle of the design.

20. The article of educational equipment of claim 16 further including an apparatus in the shape of a circle enclosing a plus sign comprising one or more arced tracks in the shape of a circle and one or more straight tracks in the shape of a plus sign, whereby tracks may be joined to one another.

* * * * *